US008091392B2

(12) United States Patent
Miller et al.

(10) Patent No.: US 8,091,392 B2
(45) Date of Patent: Jan. 10, 2012

(54) HIGH SECURITY LOCK

(75) Inventors: J. Clayton Miller, Nicholasville, KY (US); Donald P. Cooke, Jr., Nicholasville, KY (US); Michael P. Harvey, Laguna Niguel, CA (US)

(73) Assignee: Lock II, L.L.C., Nicholasville, KY (US)

( * ) Notice: Subject to any disclaimer, the term of this patent is extended or adjusted under 35 U.S.C. 154(b) by 85 days.

(21) Appl. No.: 12/554,372

(22) Filed: Sep. 4, 2009

(65) Prior Publication Data

US 2010/0064744 A1 Mar. 18, 2010

Related U.S. Application Data

(60) Provisional application No. 61/094,730, filed on Sep. 5, 2008.

(51) Int. Cl.
*E05B 15/16* (2006.01)

(52) U.S. Cl. ..... 70/333 A; 70/303 A; 70/278.1; 70/283

(58) Field of Classification Search ..... 70/303 A, 70/333 A, 275–277, 278.1, 278.7, 283; 292/142.144
See application file for complete search history.

(56) References Cited

U.S. PATENT DOCUMENTS

| | | | |
|---|---|---|---|
| 0,686,073 | A | 11/1901 | Hollar et al. |
| 1,804,277 | A | 5/1931 | Ruiz |
| 2,399,906 | A | 5/1946 | Bentley |
| 3,024,452 | A | 3/1962 | Leonard |
| 3,097,327 | A | 7/1963 | Bloor et al. |
| 3,318,625 | A | 5/1967 | Bogosian |
| 3,320,490 | A | 5/1967 | Beck et al. |
| 3,468,143 | A | 9/1969 | Douglas et al. |
| 3,633,167 | A | 1/1972 | Hedin |
| 3,718,764 | A | 2/1973 | Deschenes et al. |
| 3,733,861 | A | 5/1973 | Lester |
| 3,796,889 | A | 3/1974 | Fradkin et al. |
| 3,812,403 | A | 5/1974 | Gartner |
| 3,878,511 | A | 4/1975 | Wagner |
| 3,881,171 | A | 4/1975 | Moorman et al. |
| 3,950,678 | A | 4/1976 | Brewer |
| 3,958,231 | A | 5/1976 | Hoffman |
| 3,978,376 | A | 8/1976 | Wilson |
| 4,095,239 | A | 6/1978 | Gerry |

(Continued)

FOREIGN PATENT DOCUMENTS

DE 1065871 9/1959

(Continued)

OTHER PUBLICATIONS

Locksmith Ledger International, X-07: A Safe Lock That Operates Electronically, No. 9, Jul. 1991.

(Continued)

*Primary Examiner* — Suzanne Barrett
(74) *Attorney, Agent, or Firm* — Wood, Herron & Evans, L.L.P.

(57) ABSTRACT

A high security lock includes a lock bolt movable between extended and retracted positions, a bolt retraction gear coupled to the lock bolt, and a manually-driven gear train. When a controller verifies that user-input information is correct for unlocking the lock, the bolt retraction gear and manually-driven gear train are operatively coupled such that the gear train can drive the lock bolt from the extended position to the retracted position.

74 Claims, 33 Drawing Sheets

U.S. PATENT DOCUMENTS

| | | | |
|---|---|---|---|
| 4,114,147 | A | 9/1978 | Hile |
| 4,232,354 | A | 11/1980 | Mueller et al. |
| 4,372,590 | A | 2/1983 | Pilat et al. |
| 4,379,245 | A | 4/1983 | Goldstein |
| 4,387,918 | A | 6/1983 | Dunphy et al. |
| 4,416,127 | A | 11/1983 | Gomez-Olea Naveda |
| 4,433,355 | A | 2/1984 | Chew et al. |
| 4,438,962 | A | 3/1984 | Soloviff et al. |
| 4,446,707 | A | 5/1984 | Mullich et al. |
| 4,457,148 | A | 7/1984 | Johansson et al. |
| 4,502,048 | A | 2/1985 | Rehm |
| 4,609,780 | A | 9/1986 | Clark |
| 4,625,848 | A | 12/1986 | Meyers et al. |
| 4,631,940 | A | 12/1986 | Krivec et al. |
| 4,643,010 | A | 2/1987 | Krivec et al. |
| 4,671,087 | A | 6/1987 | Olenfalk et al. |
| 4,684,945 | A | 8/1987 | Sanderford, Jr. |
| 4,745,784 | A | 5/1988 | Gartner |
| 4,754,625 | A | 7/1988 | McGourty et al. |
| 4,755,799 | A | 7/1988 | Romano |
| 4,759,062 | A | 7/1988 | Traub et al. |
| 4,766,746 | A | 8/1988 | Henderson et al. |
| 4,770,012 | A | 9/1988 | Johannson et al. |
| 4,832,385 | A | 5/1989 | Liort |
| 4,833,465 | A | 5/1989 | Abend et al. |
| 4,899,562 | A | 2/1990 | Garner et al. |
| 4,912,460 | A | 3/1990 | Chu |
| 4,977,765 | A | 12/1990 | Legault et al. |
| 5,021,776 | A | 6/1991 | Anderson et al. |
| 5,061,923 | A | 10/1991 | Miller et al. |
| 5,070,714 | A | 12/1991 | Bedford |
| 5,083,122 | A | 1/1992 | Clark |
| 5,182,705 | A | 1/1993 | Barr et al. |
| 5,265,452 | A | 11/1993 | Dawson et al. |
| 5,299,436 | A | 4/1994 | Spitzer |
| 5,307,656 | A | 5/1994 | Gartner et al. |
| 5,487,290 | A | 1/1996 | Miller et al. |
| 5,517,184 | A | 5/1996 | Dawson et al. |
| 5,632,169 | A | 5/1997 | Clark et al. |
| 5,647,235 | A | 7/1997 | Clark et al. |
| 5,653,135 | A | 8/1997 | Miller et al. |
| 5,684,457 | A | 11/1997 | Miller et al. |
| 5,715,716 | A | 2/1998 | Miller et al. |
| 5,720,194 | A | 2/1998 | Miller et al. |
| 5,777,559 | A | 7/1998 | Dawson et al. |
| 5,847,656 | A | 12/1998 | Dawson et al. |
| 5,862,692 | A | 1/1999 | Legault et al. |
| 5,896,026 | A | 4/1999 | Higgins |
| 5,960,655 | A | 10/1999 | Miller et al. |
| 5,973,624 | A | 10/1999 | Miller et al. |
| 6,034,616 | A | 3/2000 | Harvey et al. |
| 6,052,063 | A | 4/2000 | Miller et al. |
| 6,265,973 | B1 | 7/2001 | Brammall et al. |
| 6,314,773 | B1 | 11/2001 | Miller et al. |
| 6,420,958 | B1 | 7/2002 | Miller et al. |
| 6,502,438 | B1 | 1/2003 | Miller et al. |
| 6,546,769 | B2 * | 4/2003 | Miller et al. ..... 70/303 A |
| 6,813,917 | B2 | 11/2004 | Miller et al. |
| 6,911,897 | B2 | 6/2005 | Miller et al. |
| 6,965,295 | B2 | 11/2005 | Shimonomoto et al. |
| 7,193,503 | B2 | 3/2007 | Fisher |
| 7,263,865 | B2 | 9/2007 | Miller et al. |
| 2002/0073753 | A1 | 6/2002 | Miller et al. |
| 2002/0167395 | A1 | 11/2002 | Miller et al. |
| 2004/0140890 | A1 | 7/2004 | Hartmann et al. |
| 2007/0204665 | A1 | 9/2007 | Lie-Nielsen et al. |
| 2007/0289347 | A1 | 12/2007 | Miller et al. |

FOREIGN PATENT DOCUMENTS

| | | | |
|---|---|---|---|
| DE | 3817696 | | 11/1989 |
| EP | 0021670 | A1 | 1/1981 |
| EP | 0260860 | A1 | 3/1988 |
| EP | 0361881 | A2 | 4/1990 |
| FR | 1543004 | | 10/1968 |
| GB | 2202577 | A | 9/1988 |
| WO | 80/02710 | A1 | 12/1980 |
| WO | 89-12154 | A1 | 12/1989 |

OTHER PUBLICATIONS

U.S. Patent and Trademark Office, International Search Report and Written Opinion in PCT Serial No. PCT/US2009/056060, Oct. 20, 2009.

U.S. Patent and Trademark Office, International Preliminary Report on Patentability in PCT Application Serial No. PCT/US09/56060, Jun. 20, 2011.

U.S. Patent and Trademark Office, Office Action in U.S. Appl. No. 12/356,324, filed Apr. 1, 2011.

* cited by examiner

HIGH SECURITY LOCK

CROSS-REFERENCE TO RELATED APPLICATIONS

This application claims priority to U.S. Provisional Application Ser. No. 61/094,730, filed on Sep. 5, 2008 and entitled HIGH SECURITY LOCK, the disclosure of which is hereby incorporated by reference in its entirety.

FIELD OF THE INVENTION

The present invention relates generally to locks, and more specifically, to high security locks adapted for use in safes and other security structures or areas.

BACKGROUND

Documents of an extremely sensitive nature and items having a high proprietary value often need to be stored within a safe or other structure. The structure typically includes a lock mechanism, and the structure is generally designed to be accessible only by a select few individuals who are entrusted with a predetermined combination code that facilitates the unlocking of the mechanism. Unauthorized persons will use simple lock picking tools as well as sophisticated equipment that can apply high mechanical forces or an electric or magnetic field to the lock mechanism in order to manipulate the components within the lock mechanism.

As the tools utilized in lock picking have become more sophisticated, lock mechanisms have been improved to resist these sophisticated lock picking methods. Mechanical and/or electrical elements have been used in locks to provide complicated barriers to a potential unauthorized person attempting to break into the structure. However, unauthorized persons continue to attack even these improved lock mechanisms, including drilling into the interior of the lock mechanism through lock casing openings. Locations on the lock casing that are subject to frequent attack include the mounting bolts and the spindle mount where a spindle shaft from the combination dial enters the lock casing.

Additionally, unauthorized persons attempting to break into the structure have been known to use devices that apply high acceleration to the combination dial in order to overcome security elements of the lock mechanism. The high accelerations of the gear train can sometimes force the gears controlling a lock bolt to rotate and unlock the lock mechanism without a proper combination entry. These high acceleration devices can include so-called auto-dialers, which rapidly attempt every possible combination until the proper combination has been detected. Even if the unauthorized person is unsuccessful at opening the lock mechanism in this manner, the rapid collisions of gear teeth in a gear train caused by high acceleration can frequently damage the gear train and lead to improper operations of the lock mechanism. The collisions of the gear teeth may also provide audible information that an unauthorized person can detect and use to determine the programmed combination that actuates the unlocking of the mechanism.

Furthermore, improved lock mechanisms must comply with highly stringent government specifications in order to be used on government-controlled structures and containment devices. For example, the stringency of relevant U.S. government specifications is readily appreciated from Federal Specification FF-L-2740, dated Oct. 12, 1989, titled "FEDERAL SPECIFICATION: LOCKS, COMBINATION" for the use of all federal agencies. Section 3.4.7, "Combination Redial," requires that once the lock bolt has been extended to its locked position "it shall not be possible to reopen the lock without completely redialing the locked combination." Section 3.6.1.3, "Emanation Analysis," requires that the lock shall not emit any sounds or other signals which may be used to surreptitiously open the lock within a specified period. Further U.S. government requirements are included in Federal Specification FF-L-2937, dated Jan. 31, 2005, titled "FEDERAL SPECIFICATION: COMBINATION LOCK, MECHANICAL." In that document, Section 4.7.4, "Endurance Test," requires that a sample lock be "cycled through fifty combination changes including three open and close verifications after each change" to ensure proper combination setting functionality. Section 4.7.7, "Resistance to Unauthorized Opening Test," requires that the lock cannot be opened by mechanical manipulation or autodialing of a computer-assisted device for at least a period of 20 hours.

Consequently, it would be desirable to improve on a high security lock to address the frequently-attacked areas of the lock mechanism while remaining in full compliance with typical government specifications.

SUMMARY OF THE INVENTION

A locking mechanism includes a lock bolt that moves between an extended position and a retracted position. The lock bolt is coupled to a bolt retraction gear which is movable between an engagement position and a disengagement position. In the engagement position, the bolt retraction gear is engaged with a manually-driven gear train. The locking mechanism also includes a user input device for receiving user input information and a controller for verifying user input information with stored authentication information. Upon detecting valid user input information, the controller triggers an actuator having a rotatable output element, the rotatable output element moving to allow the bolt retraction gear to move from the disengagement position to the engagement position. The user can then manually drive the gear train to retract or extend the lock bolt as desired.

In an alternative aspect, a locking mechanism includes a lock bolt that moves between an extended position and a retracted position. The lock bolt is coupled to a bolt retraction gear in operative engagement with a manually-driven gear train. The gear train includes a spindle gear and a drive gear in engagement with the bolt retraction gear, the drive gear including a relief portion. The drive gear is movable between an engagement position where the drive gear is engaged with the spindle gear and a disengagement position where the relief portion faces the spindle gear. The locking mechanism also includes a user input device for receiving user input information and a controller for verifying user input information with stored authentication information. Upon detecting valid user input information, the controller triggers an actuator having a rotatable output element, the rotatable output element moving to allow the bolt retraction gear to rotate the drive gear from the disengagement position to the engagement position. The user can then manually drive the gear train to retract or extend the lock bolt as desired.

In another alternative aspect, a locking mechanism includes a lock bolt that moves between an extended position and a retracted position. The lock bolt is operatively coupled to a bolt retraction gear. The locking mechanism includes a manually-driven spindle gear and a drive gear mounted on a drive shaft. The drive gear includes first and second relief portions and is movable between an engagement position where the drive gear engages both the spindle gear and the bolt retraction gear and a disengagement position where the first relief portion faces the spindle gear and the second relief portion faces the bolt retraction gear. The locking mechanism also includes a user input device for receiving user input information and a controller for verifying user input information with stored authentication information. Upon detecting valid user input information, the controller triggers an actuator coupled to the drive shaft that moves the drive gear from the disengagement position to the engagement position. The user can then manually drive the gear train to retract or extend the lock bolt as desired.

In an alternative aspect, a locking mechanism includes a lock casing having a front surface and a spindle sleeve extending inwardly from the front surface. The locking mechanism also includes a lock bolt and a manually-driven gear train configured to be coupled to the lock bolt to move the drive bolt between extended and retracted positions. The gear train includes a spindle shaft extending through the spindle sleeve and outside the lock casing. The locking mechanism further includes a controller having a circuit board adjacent to the front surface of the lock casing and operational circuits controlling the coupling of the lock bolt with the gear train. A circuit breaker device is adjacent to the spindle sleeve and wired into the operational circuits of the controller. Any unauthorized attempt to break into the lock casing through the spindle sleeve will force the circuit breaker device to break, thereby rendering the operating circuits of the locking mechanism inoperative.

In yet another alternative aspect, a locking mechanism includes a lock casing having a mounting bolt disposed in a bolt receptacle. The locking mechanism also includes a lock bolt having a recess and movable between extended and retracted positions in the lock casing. The locking mechanism includes a retracting bolt shield having a first member coupled to a blocking member. The blocking member is movable between a blocking position in the bolt receptacle and a non-blocking position where the mounting bolt is accessible from outside the lock casing. The first member is disposed within the lock bolt recess and as the lock bolt moves from the extended position to the retracted position, the lever member drives the blocking member to move from the blocking position to the non-blocking position.

In another alternative aspect, a locking mechanism includes a lock casing and a lock bolt disposed at least partially within the lock casing and movable between extended and retracted positions. The locking mechanism also includes a manually-driven gear train adapted to be operatively coupled to the lock bolt to drive the lock bolt between positions and a controller having operating circuits controlling the coupling of the lock bolt and the gear train. The lock casing is at least partially translucent to reveal evidence of unauthorized attempts to enter the lock bolt casing.

A method of operating a lock includes recording user input information from a user input device. A controller verifies that the user input information matches stored authentication information. The method includes moving a bolt retraction gear into engagement with a manually-driven gear train. The method then includes driving the lock bolt to a retracted position by manually driving the gear train and the bolt retraction gear.

In another alternative aspect, a method of operating a lock includes driving a lock bolt from a retracted position to an extended position by manually driving a gear train. The method includes sliding a retractable bolt shield over a mounting bolt in a bolt receptacle of the lock as the lock bolt moves from the retracted position to the extended position.

In yet another alternative aspect, a method of operating a lock includes activating a single red light-emitting diode blink once every ten seconds while a lock bolt is in a retracted position.

In an alternative aspect, a method of operating a lock includes recording user input information from a user input device. A controller verifies that the user input information matches stored authentication information. The method includes storing a parameter related to the number of unsuccessful authorization attempts by the controller since the last successful authorization. The method includes activating a single red LED blink a number of times equal to the stored parameter prior to recording user input information from the user input device.

In another alternative aspect, a method of operating a lock includes inserting a change key into the lock to enter a configuration mode. The method includes recording a first set of user input information and a second set of user input information from the user input device. The user input information sets are then averaged, and authentication information stored in the controller is replaced by the averaged user input information.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF ILLUSTRATIVE EMBODIMENTS

Figure 1:
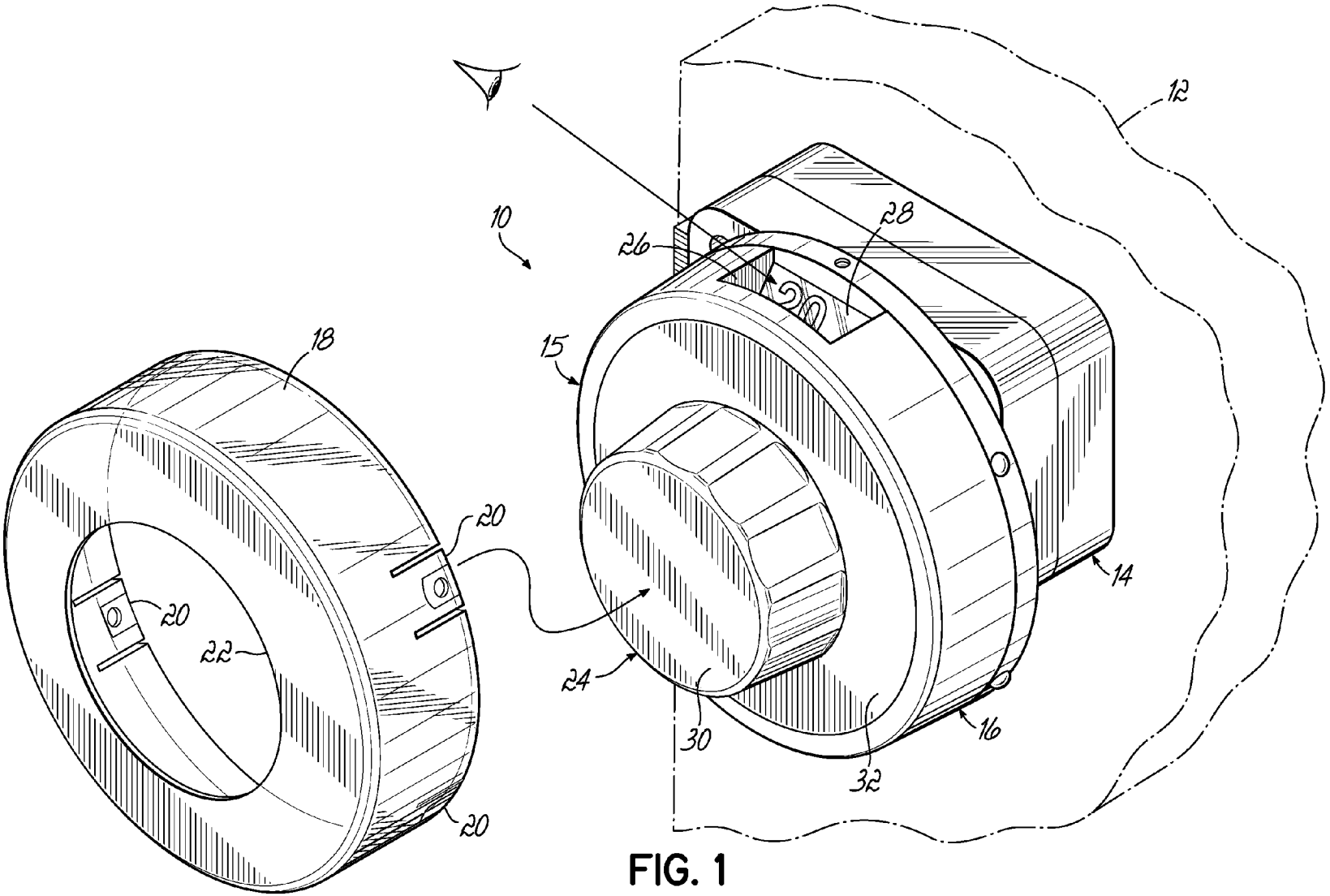
FIG. 1 is a perspective view of a high-security lock constructed in accordance with one embodiment of the invention.

FIG. 1 illustrates one embodiment of a high security lock 10 coupled, for example, to a structure door 12, and including a lock casing 14 and a user input device 15. The user input device 15 of this embodiment of the lock 10 is a mechanical lock dial 24 disposed within a dial housing 16. A dust cover 18 may be coupled to the dial housing 16 in a removable manner using suitable snap-fit connectors 20, for example, and includes an aperture 22 through which the lock dial 24 extends. The dial 24 may be rotated to input a numerical combination and, as will be explained below, the numbers of the combination are viewable through a window 26 in the dial housing 16 via a reflection in a mirror 28.

Figure 2:
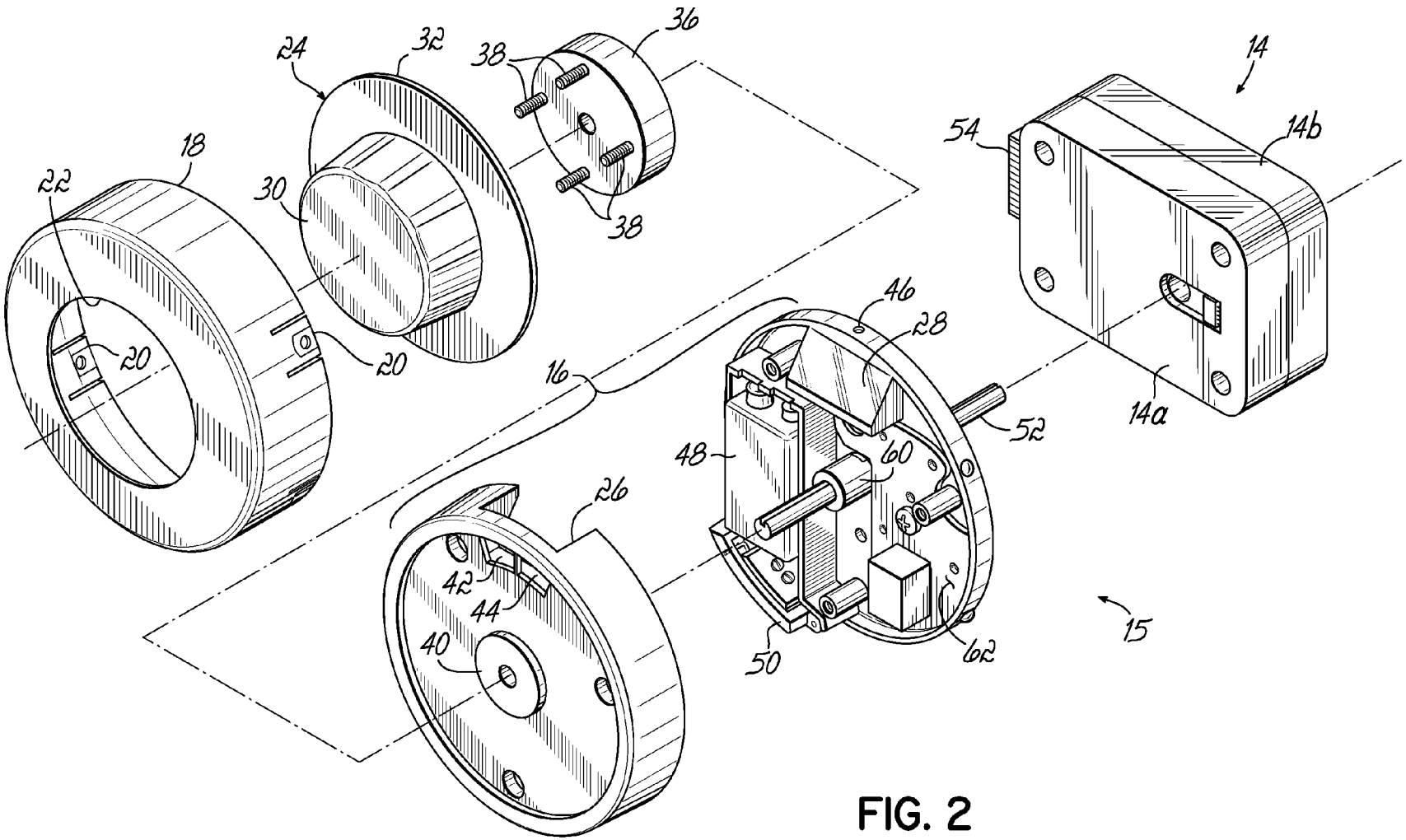
FIG. 2 is an exploded perspective view of the lock illustrated in FIG. 1.

FIG. 2 illustrates an exploded view of the user input device 15 and its contents. The dial 24 includes a protruding portion 30 which may be manually gripped by a user, and a plate portion 32 that includes the numerical combination numbers 34 on the backside thereof (see FIG. 3). A brass insert 36 is rigidly secured to the dial 24 using screw fasteners 38. The brass insert 36 can provide weight for the dial 24 and serve a bearing member for rotation against a portion 40 of the dial housing 16. The dial housing 16 includes windows 42, 44 for allowing the numbers on the back side of the dial plate portion 40 to be viewed via a reflection in the mirror 28. An LED indicator light 46 is provided and may be used in various manners to provide indication of combination input. A battery 48, such as a standard 9-volt battery, is removably placed in the dial housing 16 through a battery door 50, and provides power for the electronic circuit and servo motor to be discussed below. A rotatable spindle shaft 52 is provided for transferring rotation of the dial 24 to the bolt retraction hardware upon input of a correct combination code.

Figure 3:
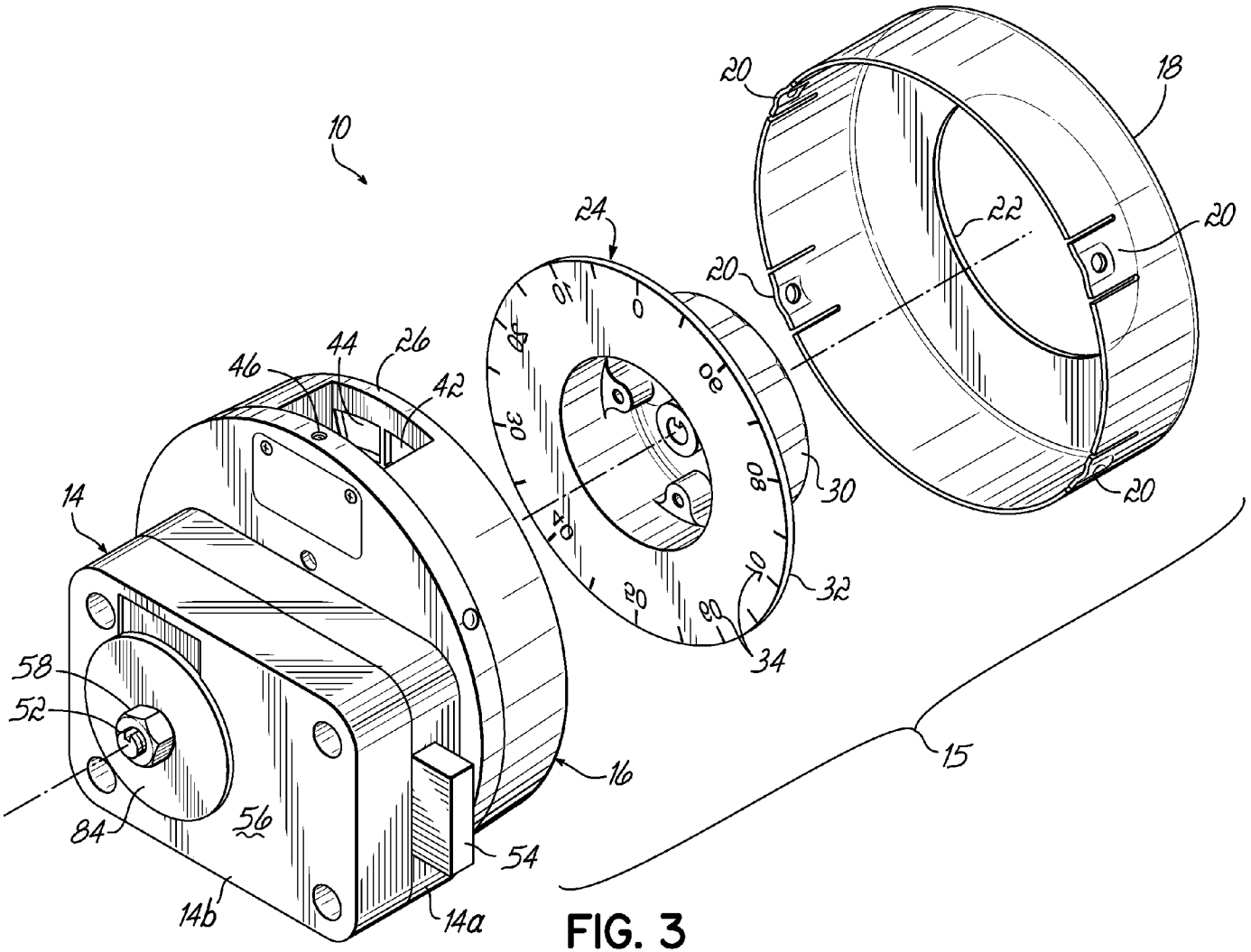
FIG. 3 is an exploded rear perspective view of the lock.

FIG. 3 illustrates a rear perspective view of the lock 10 and illustrates a lock bolt 54 extending from the lock casing 14. The shaft 52 extends through a back side 56 of the lock casing 14 and is secured with a nut 58 in such a manner as to allow rotation of the shaft 52 when the dial 24 is rotated. As further shown in FIG. 3, the back side of the dial plate portion 32 includes combination numbers, which, when reflected in the mirror 28 (FIG. 2) will be viewable by the user.

Figure 4:
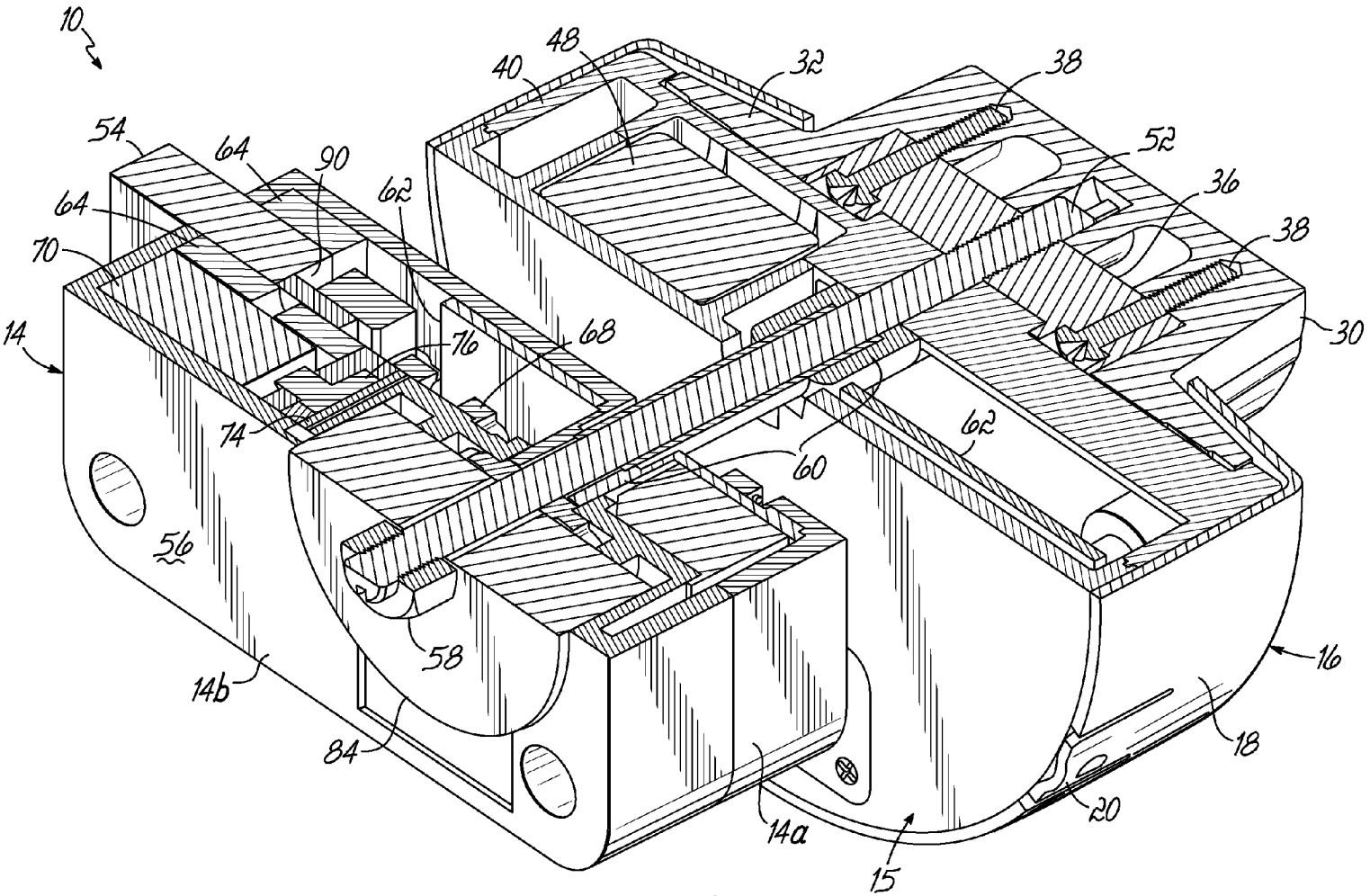
FIG. 4 is a perspective cross-sectional view of the lock taken along the longitudinal central axis thereof.

FIG. 4 illustrates a longitudinal cross-sectional view, in perspective, of the lock 10, including the various components described above. In particular, the spindle shaft 52 is shown extending completely through the dial housing 16 and the lock casing 14. One or more spindle sleeves 60 receive the spindle shaft 52 along its length. Such sleeves 60 will help prevent undesired entry into the lock casing 14 and access of the various bolt retraction hardware if the shaft 52 were to be removed.

Figure 5:
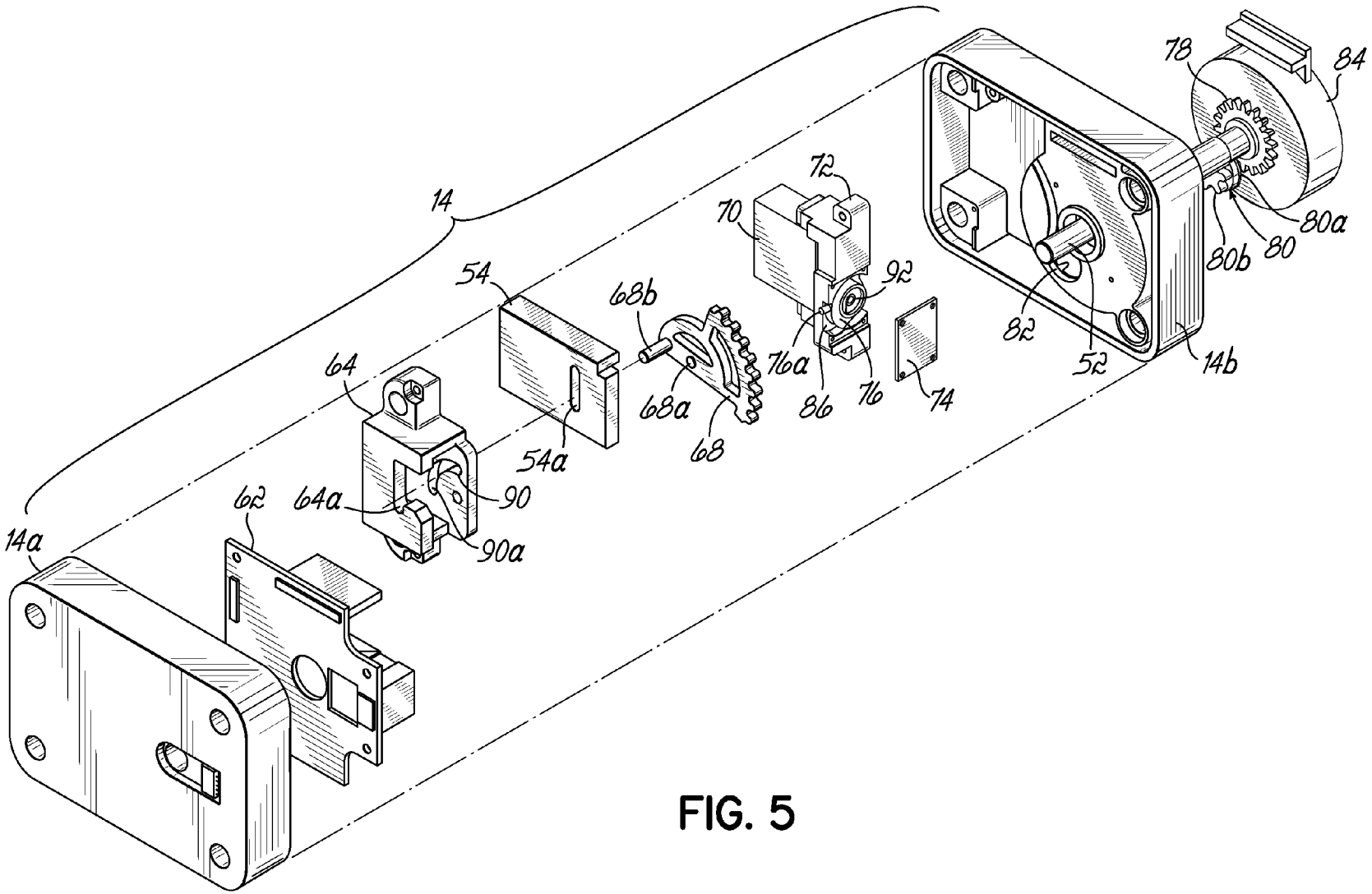
FIG. 5 is an exploded perspective view of the lock casing and bolt retraction hardware.
Figure 6:
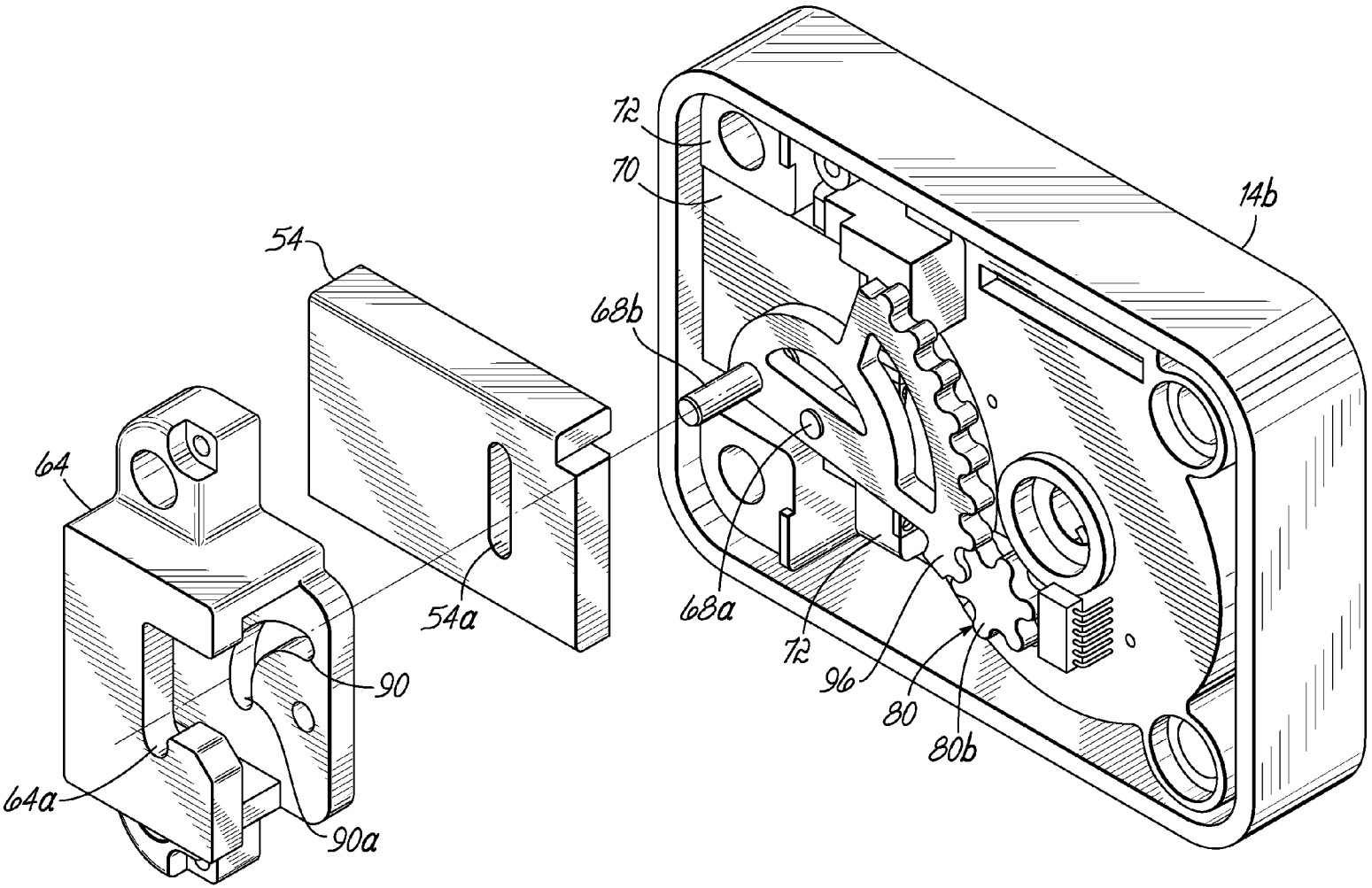
FIG. 6 is a perspective view, partially exploded to illustrate various bolt retraction hardware.
Figure 7:
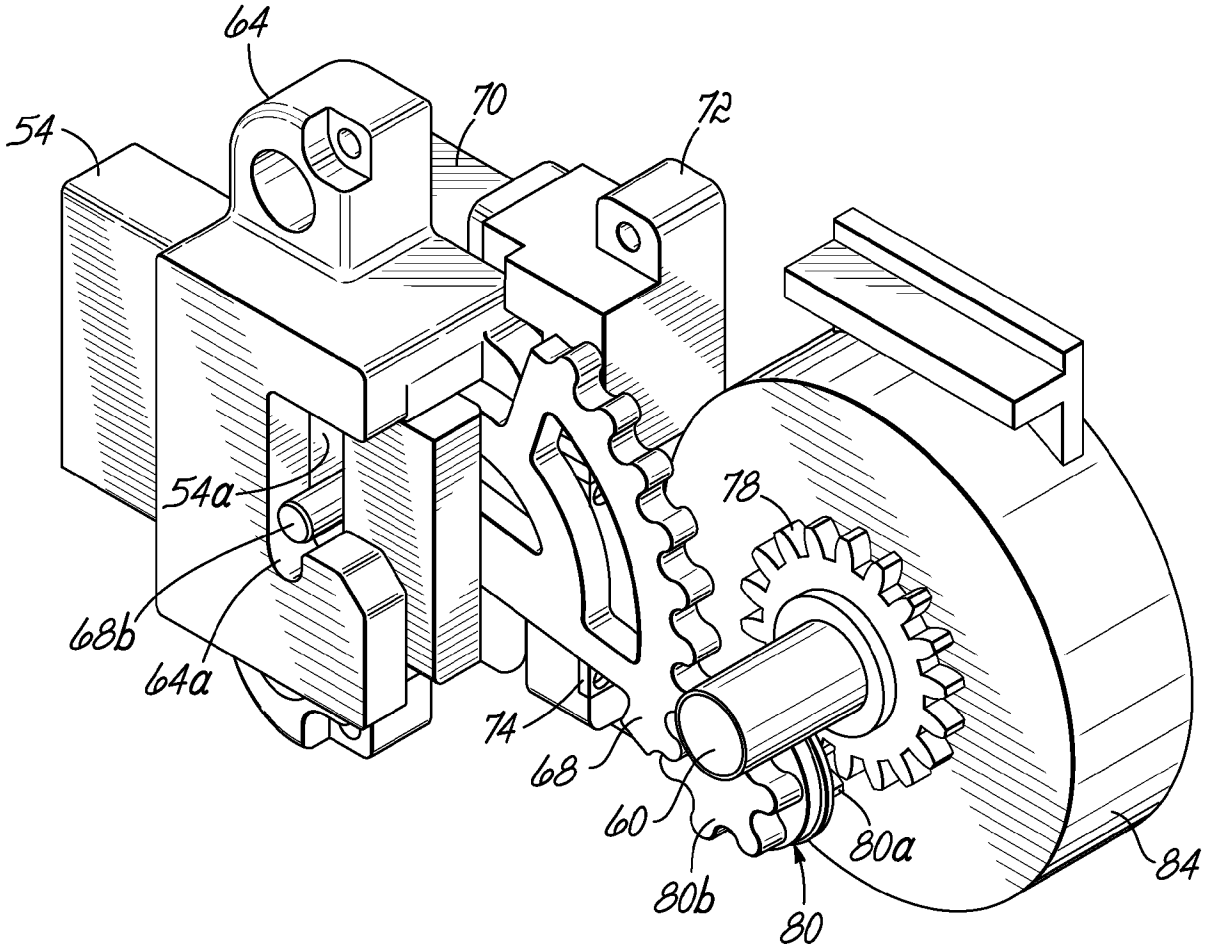
FIG. 7 is a perspective view of the bolt retraction assembly.

Turning to FIG. 5, the lock casing 14 is shown in exploded form to illustrate the circuit board 62 and various lock bolt retraction hardware, including a bolt guide member 64, the bolt 54, a bolt retraction gear 68, an actuator 70, a pivot block 72, and a cover 74 for fastening to the pivot block 72 and covering a rotating output element 76 of the actuator 70. The lock casing 14 includes a front casing half 14*a* and a rear casing half 14*b*. The circuit board 62 is placed on a front inner side of the front casing half 14*a*. Therefore, if a drill is used to drill into the lock casing 14 from outside of the door 12, the drill bit will first contact the circuit board 62 and likely disable the lock 10, thereby making entry more difficult. A spindle gear 78 is coupled for rotation with the spindle shaft 52 and the connected dial 24 (FIG. 4). The spindle gear 78 meshes with a first gear portion 80*a* of a drive gear element 80. An opposite or second gear portion 80*b* of the drive gear element 80 extends through an aperture 82 in the rear casing half 14*b*, such that it may mesh with the bolt retraction gear 68 upon input of a correct combination code as shown in FIGS. 6 and 7. An encoder 84 is used to detect input of combination codes via rotation of the shaft 52 and is used in conjunction with suitable controller circuitry on the circuit board 62.

Figure 8A:
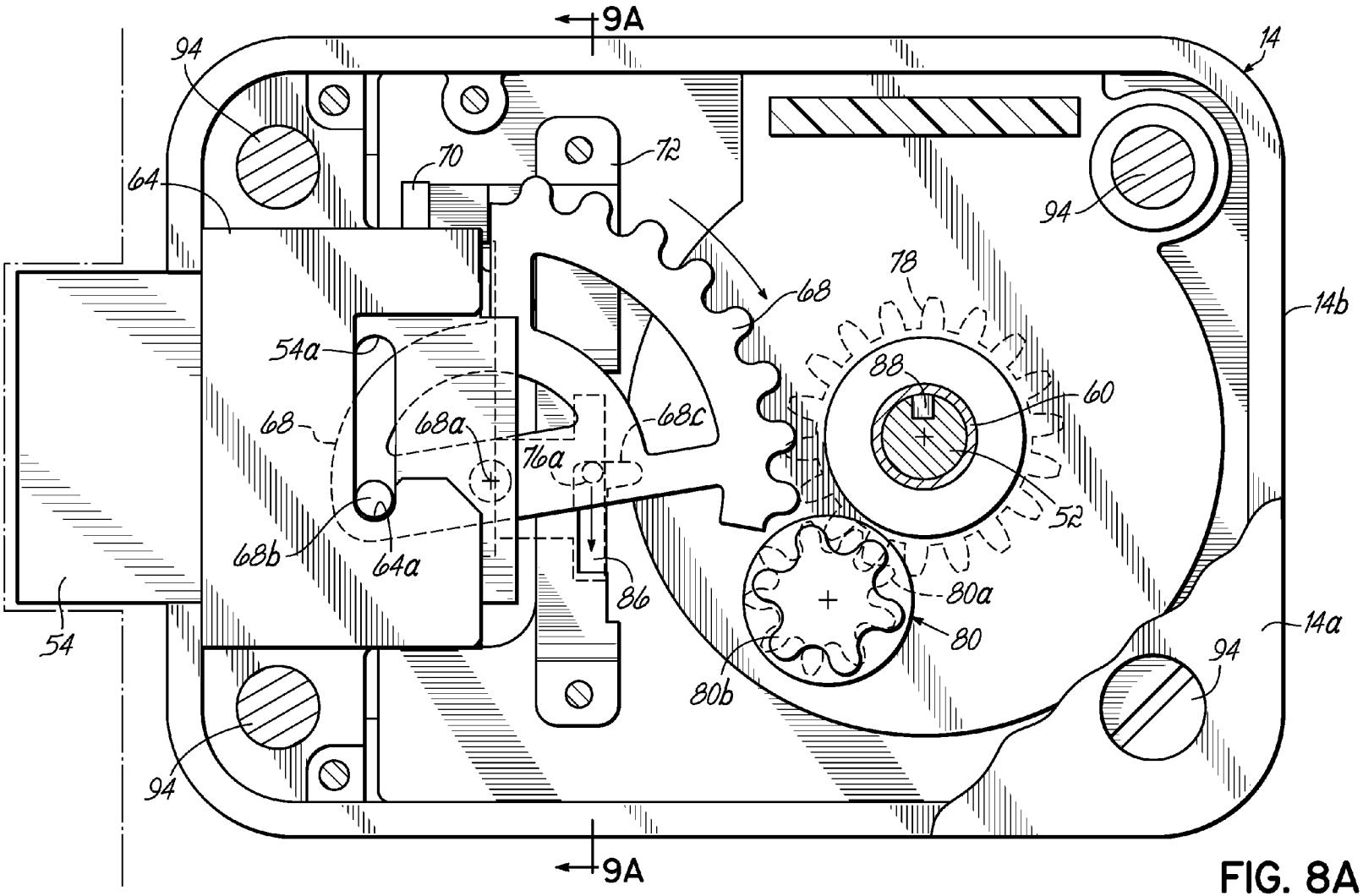
FIG. 8A is an elevational view partially broken away illustrating the bolt retraction hardware with the bolt in an extended or locked position.
Figure 8B:
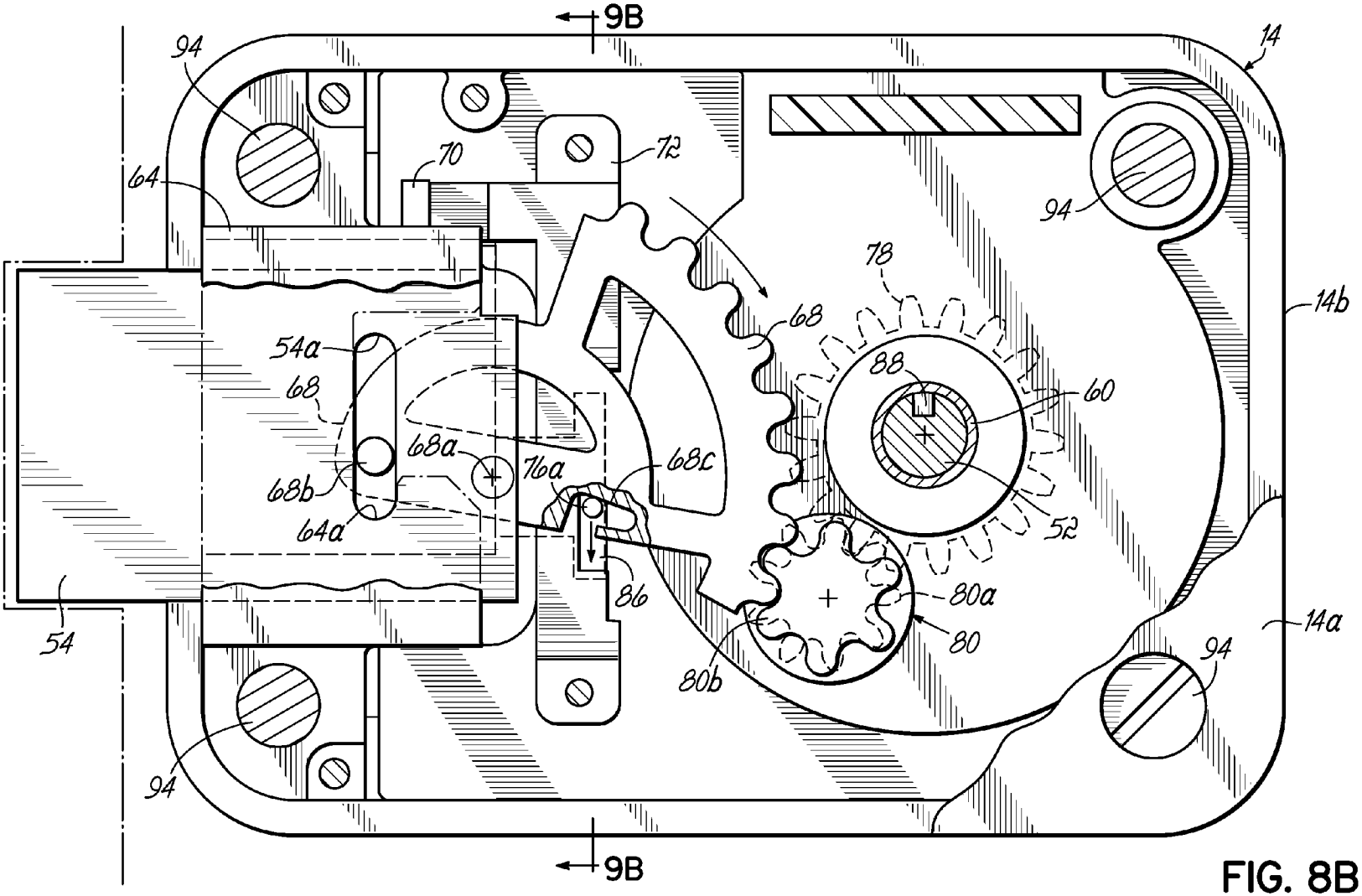
FIG. 8B is an elevational view similar to FIG. 8A, illustrating an initial portion of the bolt retraction sequence.
Figure 8C:
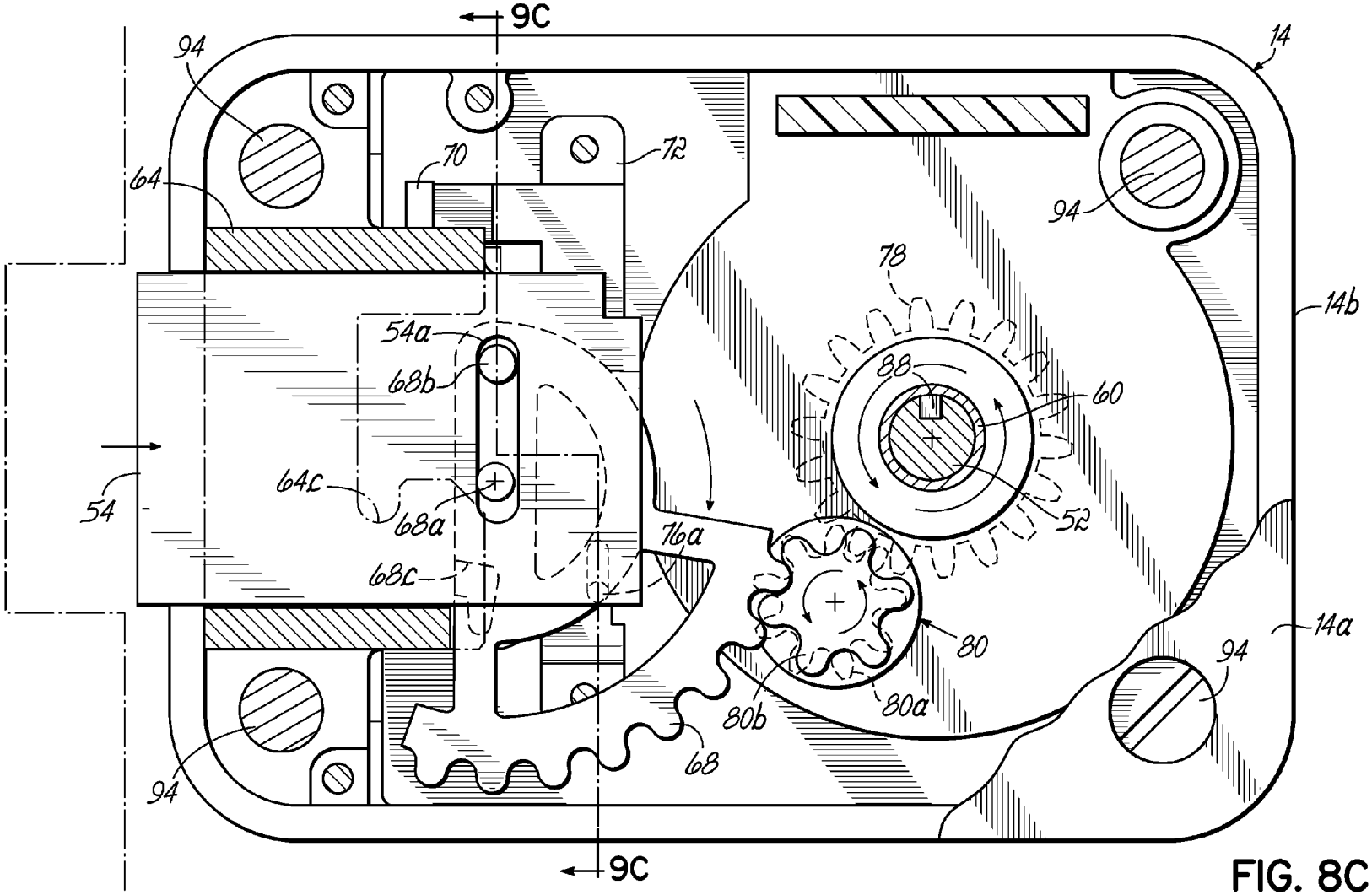
FIG. 8C is an elevational view similar to FIG. 8B, illustrating the fully retracted position of the bolt and associated bolt retraction hardware.
Figure 9A:
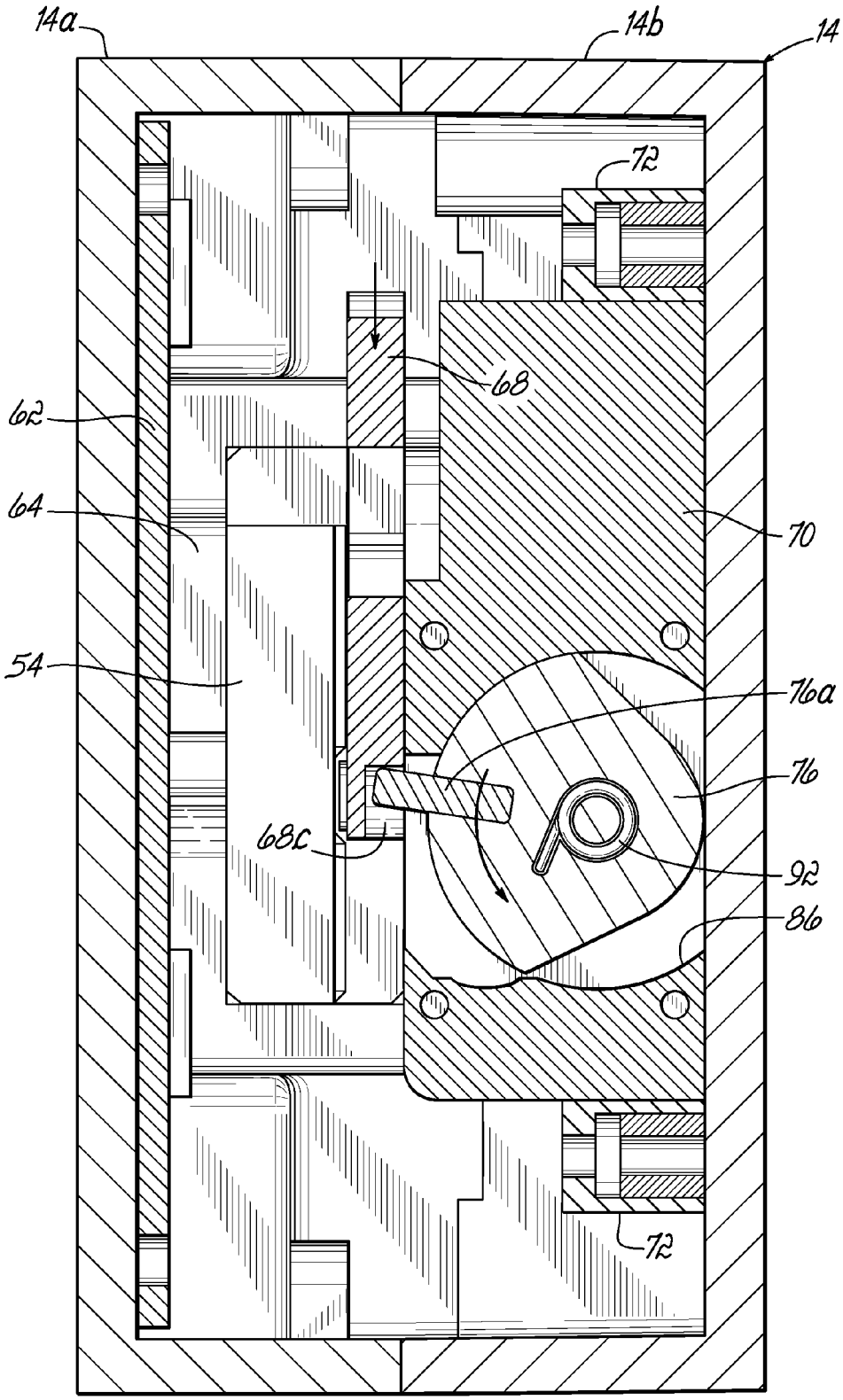
FIG. 9A is a cross-sectional view taken along the line 9A-9A of FIG. 8A.
Figure 9B:
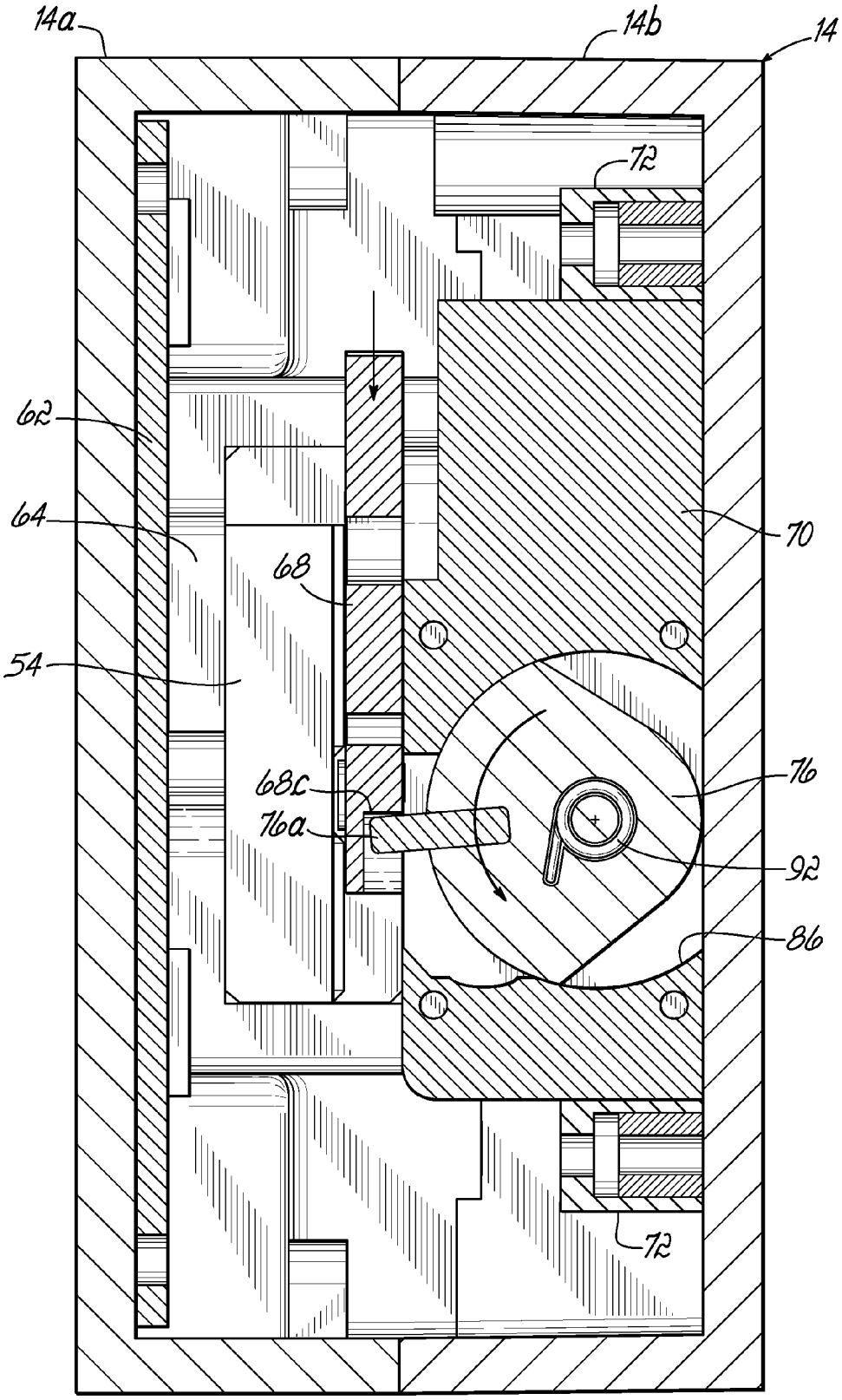
FIG. 9B is a cross-sectional view taken along line 9B-9B of FIG. 8B.
Figure 9C:
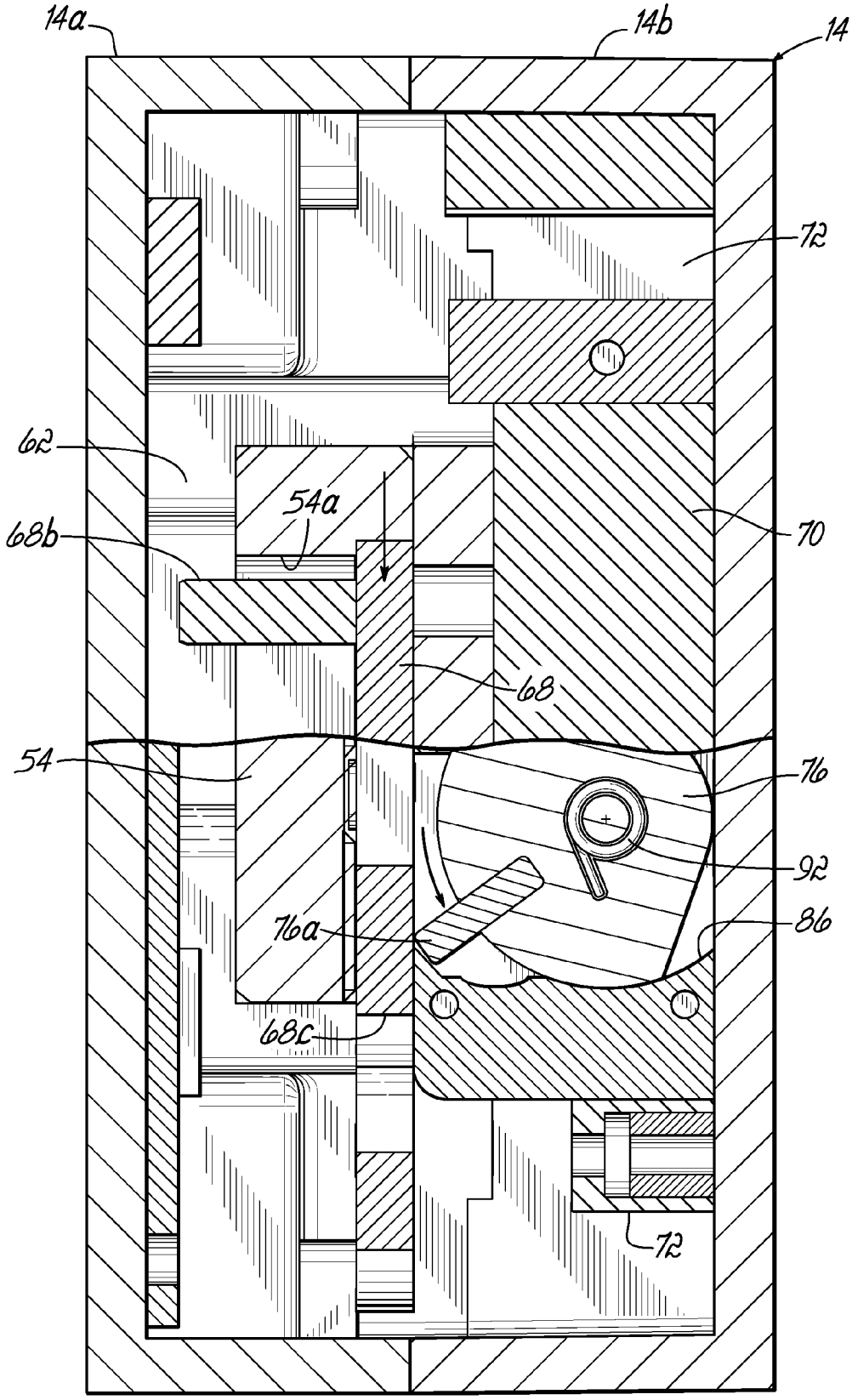
FIG. 9C is a cross-sectional view taken along line 9C-9C of FIG. 8C.

Turning to FIGS. 6 and 7, taken in conjunction with FIGS. 8A-8C and 9A-9C, the bolt retraction sequence will now be discussed. Upon entry of the correct combination code as recognized by the encoder and controller circuitry, the actuator 70 will be activated such that its output element 76 rotates. The output element 76 includes a pin 76*a* that will rotate through a slot 86 in the pivot block 72 (FIG. 5) and also move through a slot 68*c* in the bolt retraction gear 68. Normally this pin 76*a* would prevent rotation of the bolt retraction gear 68, as shown in FIG. 8A, for example. However, when the output element 76 of the actuator 70 rotates and moves the pin 76*a* in a downward direction, as viewed in FIGS. 8A-8C, this allows the bolt retraction gear 68 to move or rotate clockwise as viewed in FIGS. 8A-8C, such that it may engage with the second portion 80*b* of the drive gear element 80. Although not shown in the drawings, the bolt retraction gear 68 is slightly spring-loaded, with, for example, a torsion spring of low spring force, such that the bolt retraction gear 68 is biased in the clockwise direction to the position shown in FIG. 8B upon activation of the actuator 70. Once the gears 68, 80*b* are engaged as shown in FIG. 8B, the dial 24 may be manually rotated such that the drive gear element 80 is rotated through engagement of the first drive gear portion 80*a* with the spindle gear 78. As shown in FIGS. 8A-8C, the spindle gear 78 is coupled to the shaft 52 by a key 88. When the bolt retraction gear 68 is engaged with the drive gear portion 80*b* as shown in FIG. 8B, the bolt retraction gear 68 will rotate about its pivot axis 68*a*, and a pin 68*b* secured to the bolt retraction gear 68 will rise out of a position seated in a recess 64*a* of the bolt guide member 64 and the end 90*a* of a curved slot or pin guide 90 of the bolt guide member 64 (FIG. 5). The pin 68*b* also extends through a slot 54*a* in the bolt 54, and as the bolt retraction gear 68 rotates, the pin 68*b* rides upwardly in the slot 54*a* as viewed in FIGS. 8B and 8C and simultaneously moves the bolt 54 into the lock casing 14 and through the bolt guide member 64. Rotating the dial 24, shaft 52, and gears 78, 80, 68 in the opposite direction will extend the bolt 54 back to its fully-extended position and the bolt retraction gear 68 will be returned to the initial position shown in FIG. 8A by the pin 76*a*. In this regard, the output element 76 is spring-loaded by use of a spring 92 such that when the actuator 70 is deactivated, the spring 92 will return the pin 76*a* to the initial position shown in FIG. 9A, and the spring force of the output element 76 is sufficiently strong to force the bolt retraction gear 68 to the initial position shown in FIG. 8A.

The use of a dial plate portion 32 and mirror 28 allows for placement of the battery 48 in the dial housing 16 in a space efficient manner. The lock casing portions 14*a*, 14*b* are mechanically fixed together, such that if they are pried apart, the mechanical elements (not shown) fixing the lock casing 14 together will break. It will be appreciated that the bolts 94 extending through the lock casing 14 do not fasten the lock casing portions 14*a*, 14*b* together, but merely serve to secure the lock casing 14 to, for example, a door 12. Another manner of surreptitious entry into locks may involve using a hammer from the outside to force the spindle shaft 52 through the lock 10. In the present lock, however, this does not move the casing 14, and, therefore, there would be no need for a "relock" feature as used in other high-security locks. The actuator 70 is a servo motor 70 in the illustrated embodiment. The use of the servo motor 70, such as a micro-servo as opposed, for example, to a stepper motor, has advantages. For example, the servo motor 70 includes a relatively complex gear train that involves several revolutions in order to rotate the output element 76 through just a partial rotation as discussed above. Thus, the servo motor 70 would be difficult to activate in some surreptitious manner. The pin 68*b* used on the bolt retraction gear 68 rests in a recess in its home position with the lock bolt 54 extended as shown in FIG. 8A. Thus, if the lock bolt 54 is forced inwardly in a surreptitious attempt to compromise the lock 10, the force will not be exerted against the gear train, but rather against the bolt guide member 64, which may be designed and configured to withstand high forces.

Figure 10:
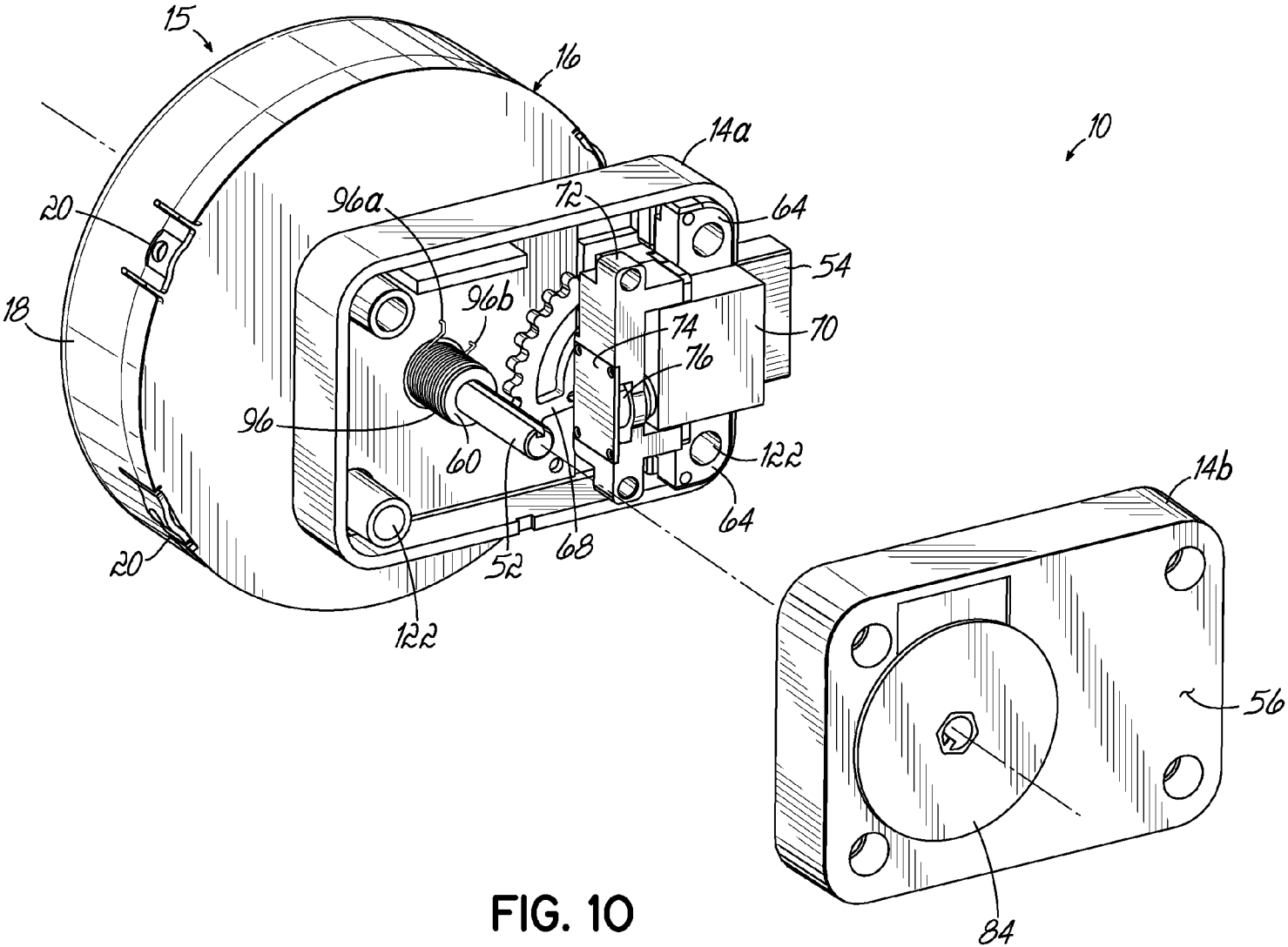
FIG. 10 is a rear perspective view of the lock of FIG. 1 with the lock casing partially exploded to illustrate a circuit breaker boil.

With reference to FIG. 10, the lock 10 further includes a circuit breaker device 96. The circuit breaker device 96 of the illustrated embodiment consists of a continuous conductive wire having a first end 96*a* and a second end 96*b*, each end 96*a*, 96*b* electrically connected to the circuit board 62. The circuit breaker device 96 is connected integrally into the primary controller circuits for the lock 10 such that if the circuit breaker device 96 is broken, the lock 10 will become inoperable. As seen in FIG. 10, the circuit breaker device 96 is disposed adjacent to the spindle sleeve 60 that carries the spindle shaft 52 as the shaft 52 enters the lock casing 14. An unauthorized person trying to circumvent the lock 10 may remove the user input device 15 and then attempt to drill into the spindle sleeve 60 at the front opening of the lock casing 14. However, any attempt to surreptitiously enter the lock casing 14 through the spindle sleeve 60 will cause the circuit break device 96 to break, thereby thwarting this method of attack on the lock 10. The circuit breaker device 96 is illustrated as a coil in FIG. 10, the coil being wrapped around the spindle sleeve 60. One skilled in the art will recognize that the circuit breaker device 96 may also comprise a plurality of wires.

Figure 11:
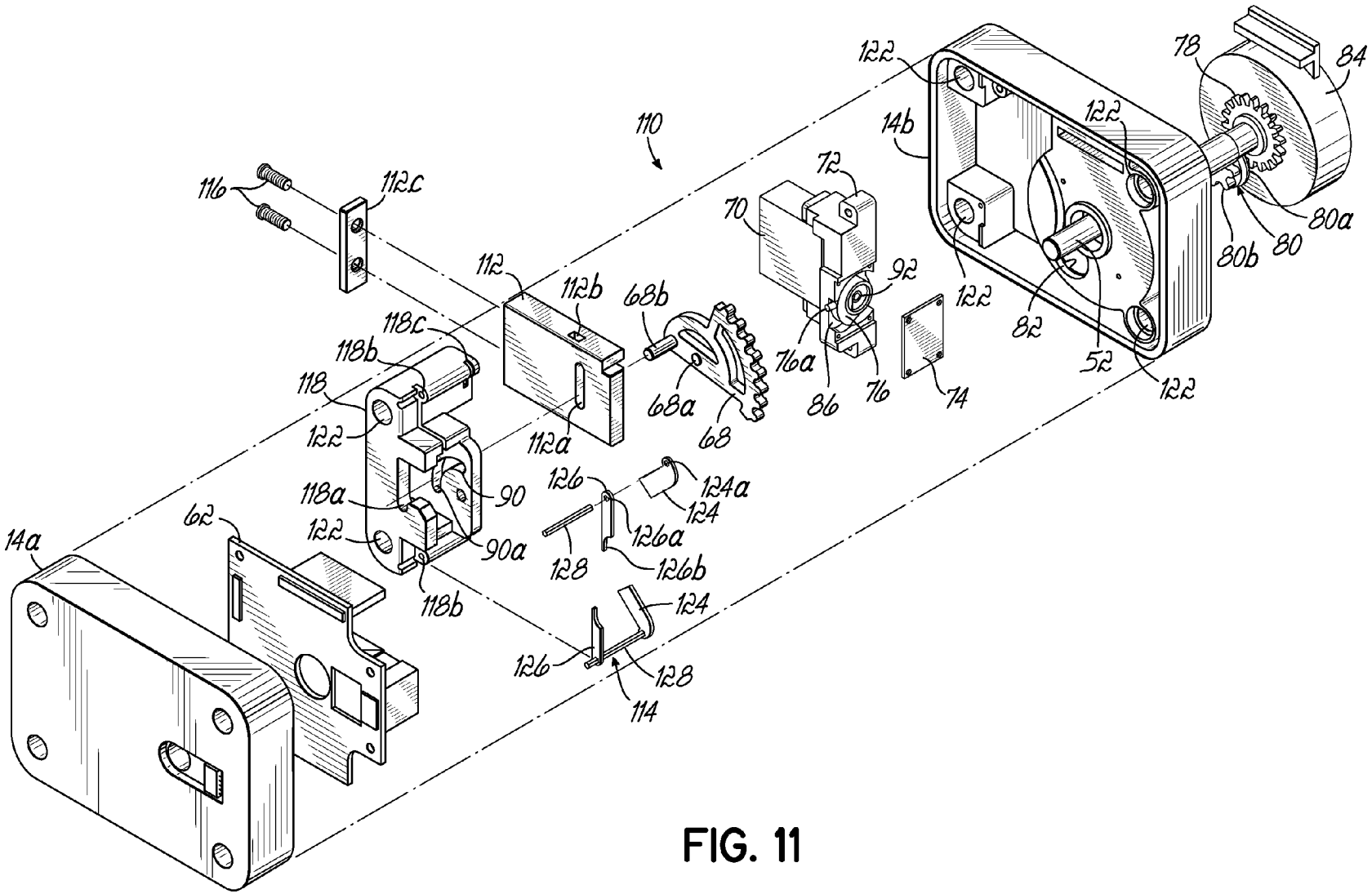
FIG. 11 is an exploded perspective view of an alternative embodiment of the lock casing and bolt retraction hardware.

With reference to FIGS. 11-14C, another embodiment of a lock 110 is illustrated. As most clearly shown in the exploded view of the lock casing 14 and inner lock hardware of FIG. 11, the lock 110 includes many of the same elements as the first embodiment of the lock 10, such as the circuit board 62, bolt retraction gear 68, and actuator 70. In this application, reference numerals remain the same for similar elements in the various embodiments described. This embodiment of the lock 110 follows the same bolt retraction sequence illustrated in FIGS. 6-9C and described above, and the lock 110 includes a different lock bolt 112 and a retracting bolt shield 114. The lock bolt 112 includes a slot 112*a* adapted to receive the pin 68*b* of the bolt retraction gear 68. The lock bolt 112 further includes a pair of opposing recesses 112*b* used in the retracting bolt shield 114 as described in detail below, and also a bolt extension 112*c*. The bolt extension 112*c* is coupled to the lock bolt 112 with threaded fasteners 116 that are disposed flush with the bolt extension 112*c* outer surface when the bolt extension 112*c* is placed on the lock bolt 112. In the embodiment of FIG. 11, the bolt extension 112*c* has a thickness of about one-tenth (0.100) to three-sixteenths (0.1875) of an inch. Various government contractors have manufactured locks for the United States government, and one of the primary lock manufacturers designed lock bolts that were flush with the lock casing when retracted, while another primary lock manufacturer designed lock bolts that extended about three-sixteenths (0.1875) of an inch beyond the lock casing when retracted. The bolt extension 112*c* can be added to the lock bolt 112 if necessary for the door 12 selected. Thus, the lock bolt 112 can be configured for use with any type of door.

Figure 12:
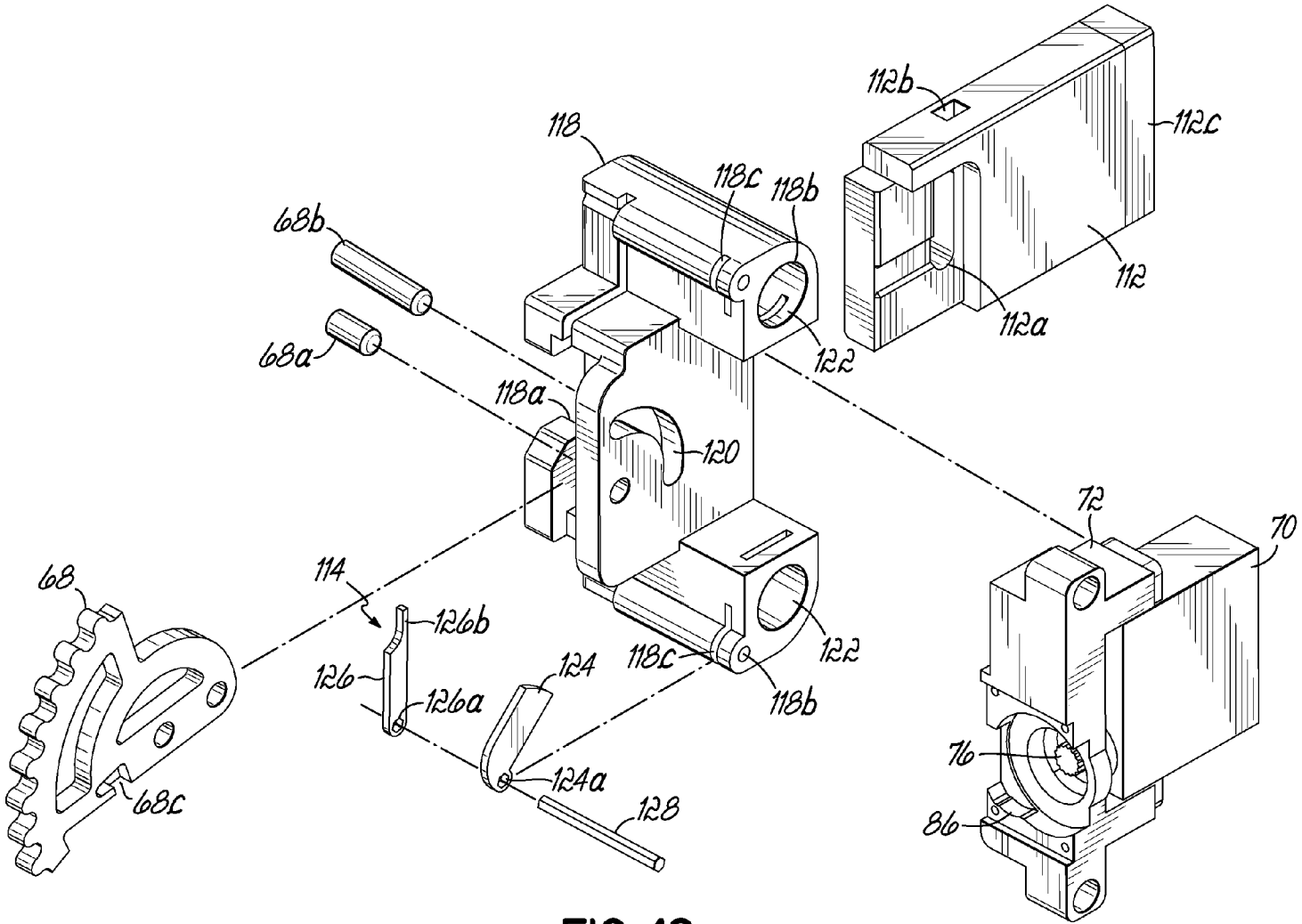
FIG. 12 is an exploded view of the bolt retraction hardware and retracting mounting screw shield of FIG. 11.
Figure 13:
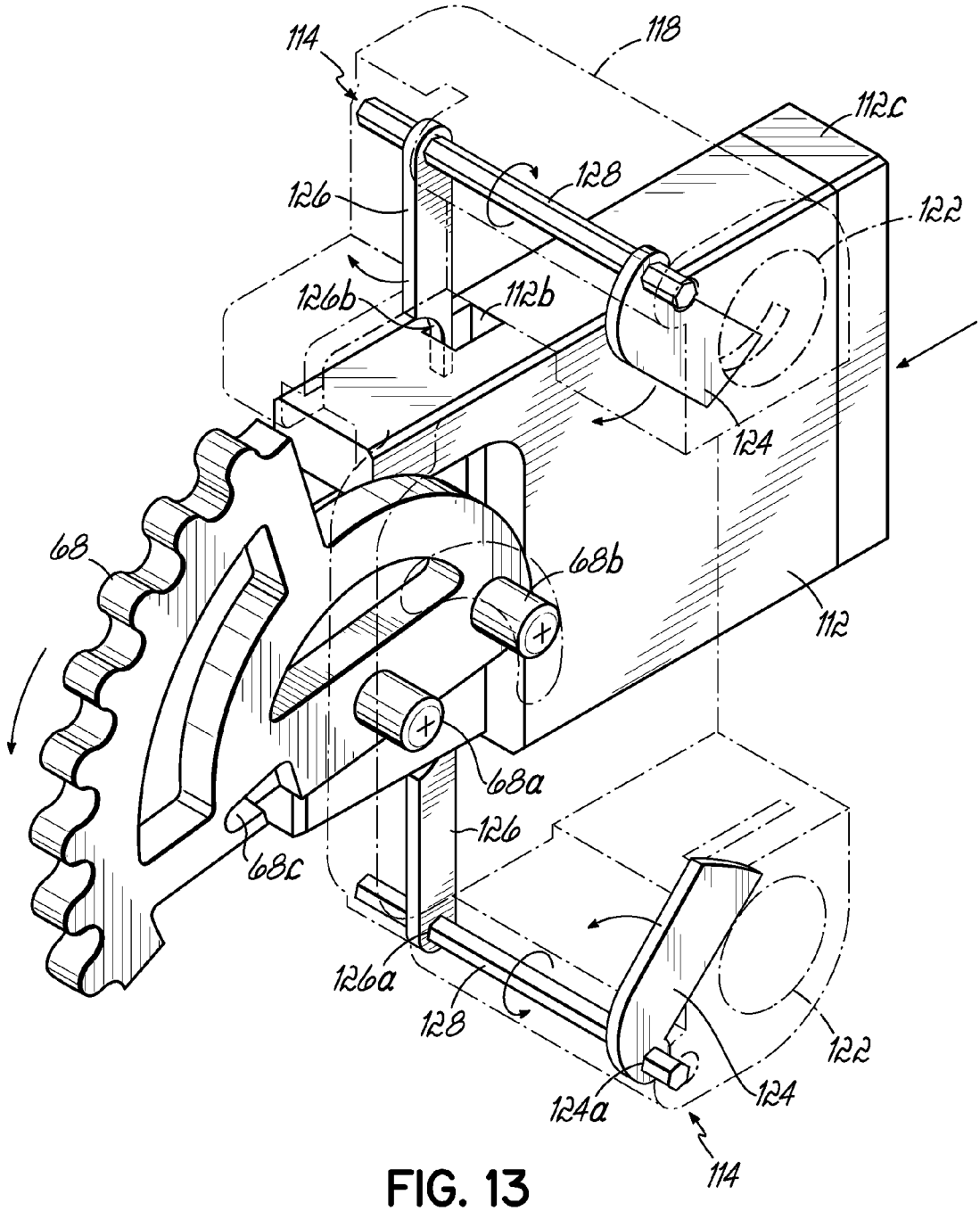
FIG. 13 is a perspective view of the bolt retraction hardware and retracting mounting screw shield of FIG. 11.

As shown in the previous embodiment, the mounting bolts 94 of the lock casing 14 are accessible from the back side 56 of the lock casing 14. An unauthorized person having access to this rear side 56 could remove the mounting screws 94 and replace the lock casing 14 with a lock body of a different mechanism, thereby compromising the lock 110. To address this problem, the lock 110 of the current embodiment includes the retracting bolt shield 114. As shown in FIGS. 11 and 12, the lock 110 includes a modified bolt guide member 118. The bolt guide member 118 continues to include a recess 118*a* and a curved slot 120 for engaging the pin 68*b* of the bolt retraction gear 68. The bolt guide member 118 also has a pair of longitudinally-directed apertures 118*b* formed on opposing sides of the bolt guide member 118. These longitudinally-directed apertures 118*b* are in communication with laterally-directed slots 118*c*, the slots 188*c* extending from an edge of the bolt guide member 118 to longitudinal receptacles 122 holding the mounting bolts 94. The retracting bolt shield 114 includes a blocking member 124 with a non-circular aperture 124*a*, a first member 126 with a non-circular aperture 126*a*, and a non-circular drive rod 128 operatively coupling the blocking member 124 to the first member 126 at the non-circular apertures 124*a*, 126*a*. The drive rod 128 is positioned within one of the longitudinally-directed apertures 118*b* of the bolt guide member 118 while the blocking member 124 is at least partially disposed in one of the lateral slots 118*c*, as most clearly shown in FIG. 13. The drive rod 128 and associated apertures 124*a*, 126*a* are hexagonal in the illustrated embodiment, but one skilled in the art will appreciate that any alternative non-circular shape may be chosen for these elements. The first member 126 has a first end 126*b* configured to engage the lock bolt 112 and more specifically, one of the recesses 112*b* in the lock bolt.

Figure 14A:
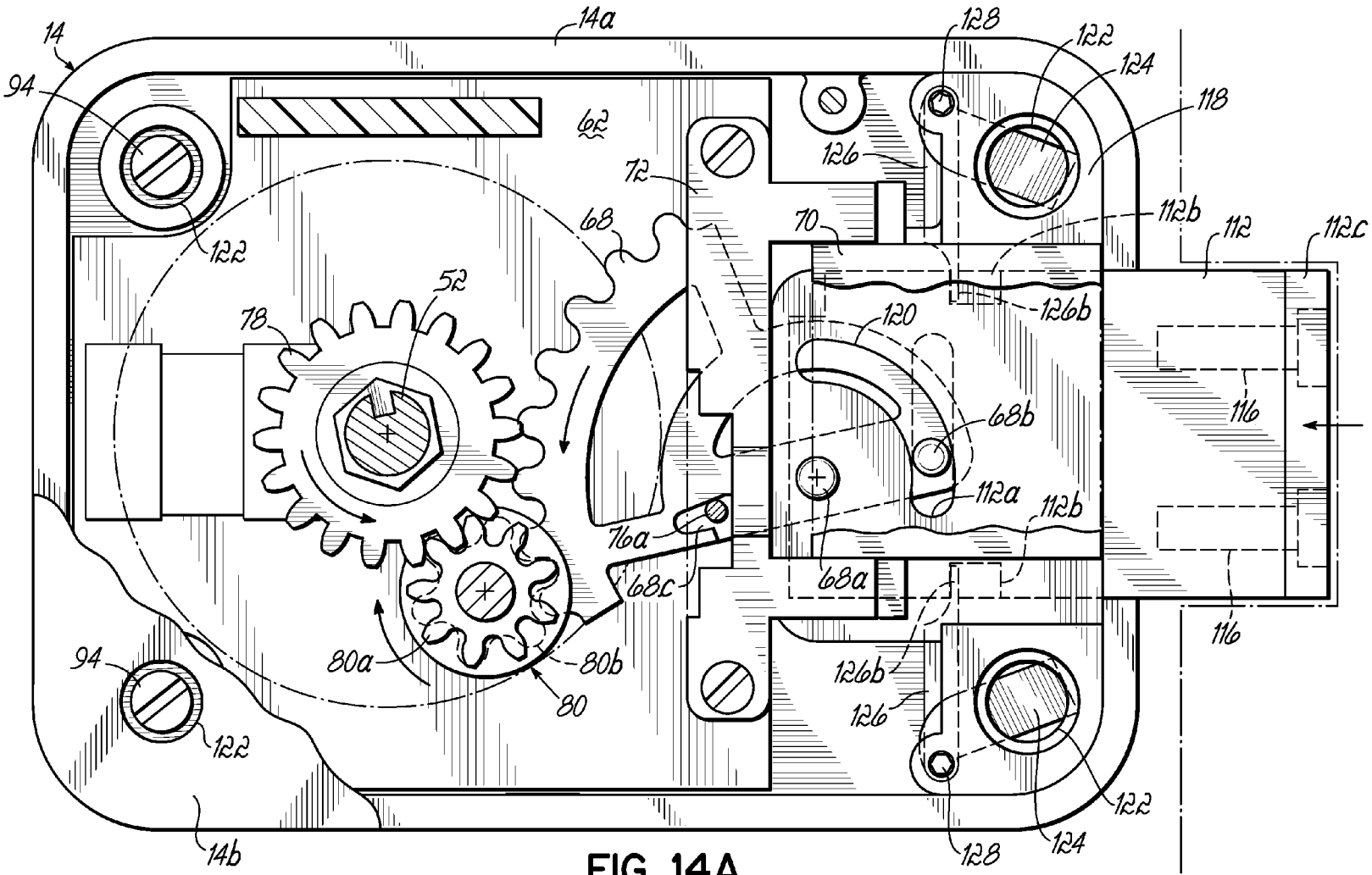
FIG. 14A is an elevational view illustrating the retracting mounting screw shield of FIG. 11 in a locked position of the bolt retraction hardware.
Figure 14B:
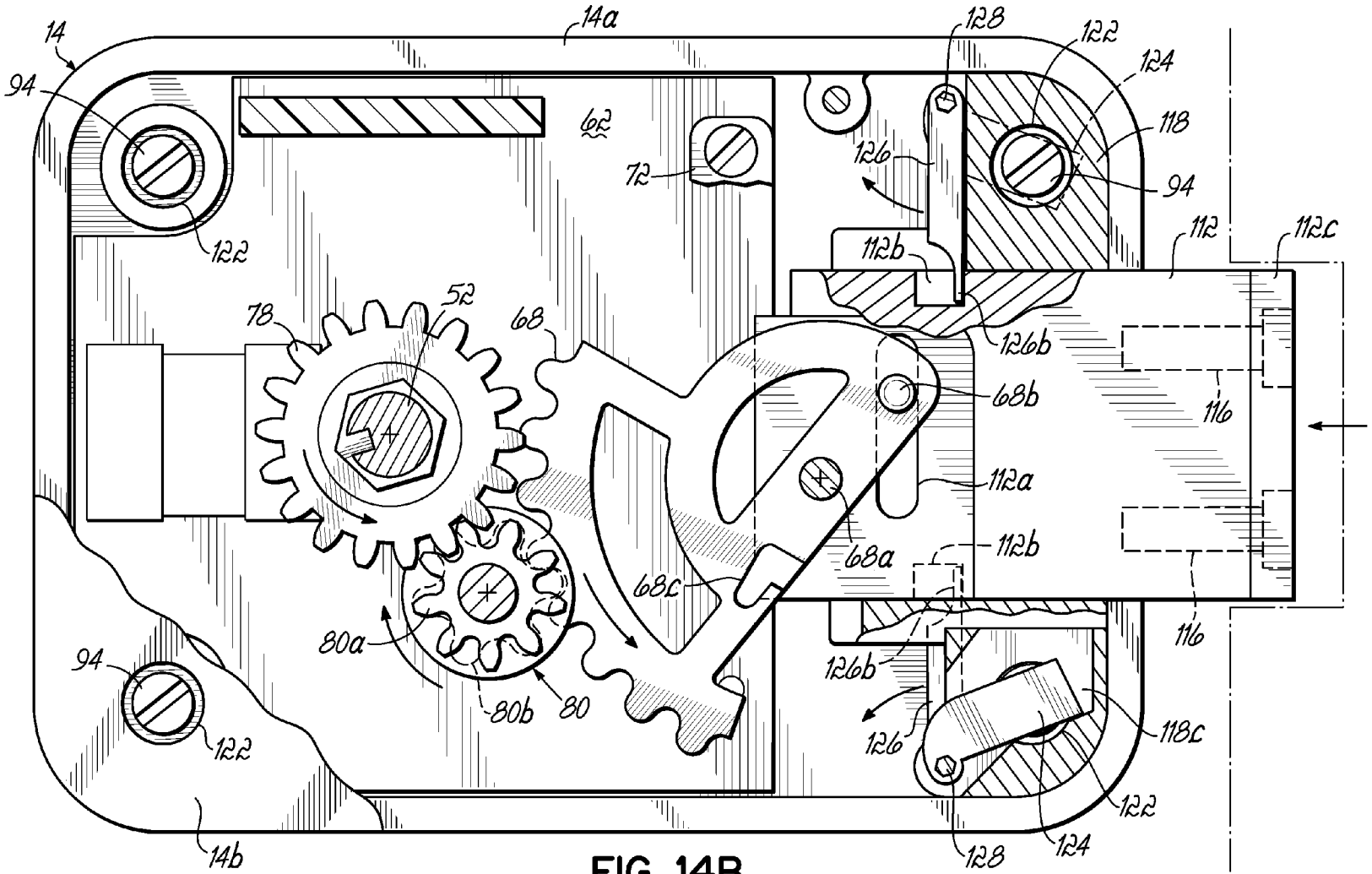
FIG. 14B is an elevational view similar to FIG. 14A, illustrating an initial portion of the bolt retraction sequence.
Figure 14C:
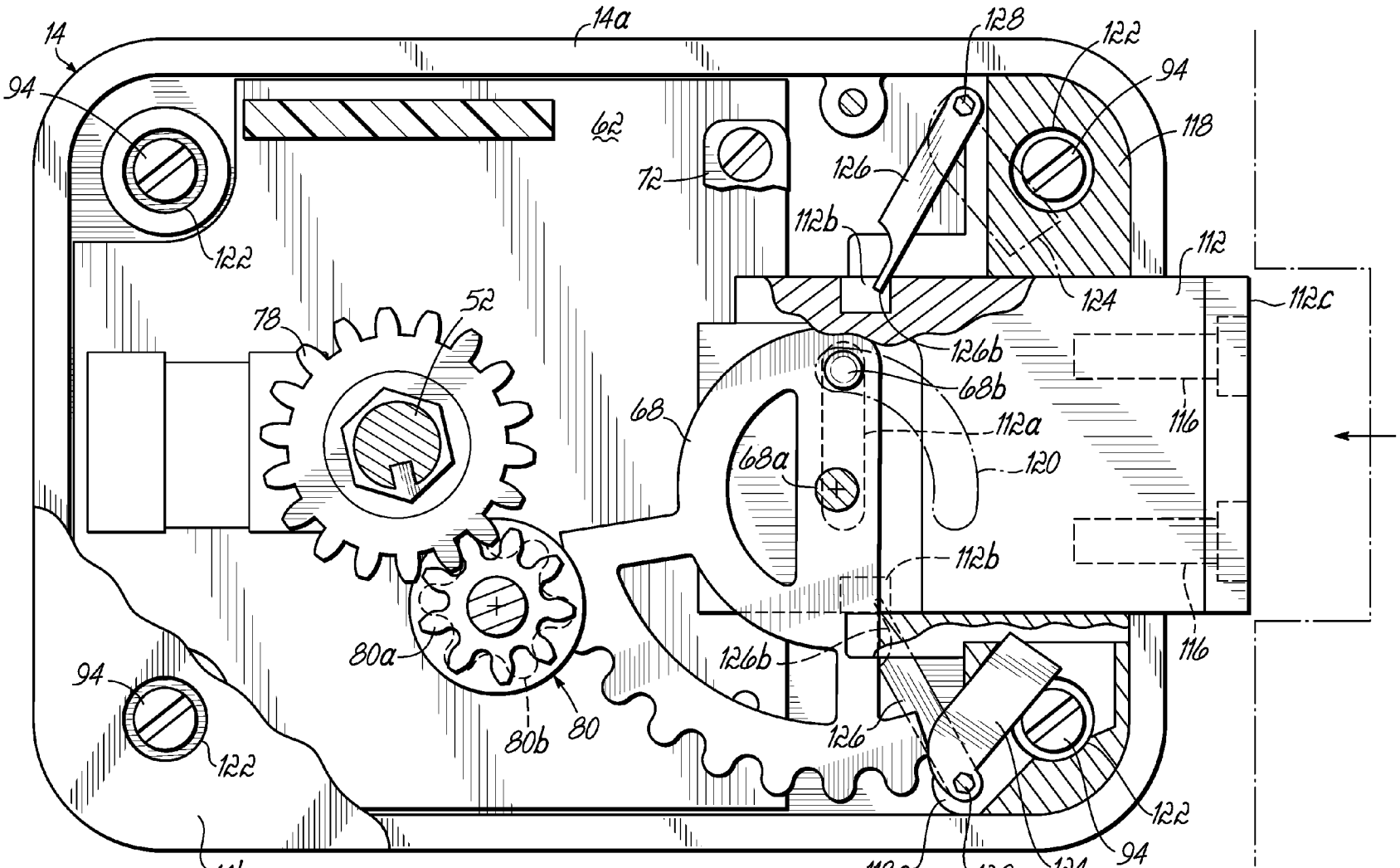
FIG. 14C is an elevational view similar to FIG. 14A, illustrating the fully retracted position of the bolt and associated rotation of the retracting mounting screw shield.

The operation of the retracting bolt shield 114 is illustrated in a sequence of illustrations at FIGS. 14A-14C. In FIG. 14A the bolt retraction gear 68 has just been engaged with the gear train 78, 80 to begin the process of retracting the lock bolt 112. When the lock bolt 112 is in the extended position, the blocking members 124 completely conceal the mounting bolts 94 on the bolt-side of the lock 110. In FIG. 14B, the bolt retraction gear 68 has moved to partially retract the lock bolt 112. In this operational state, the blocking members 124 continue to conceal the mounting bolts 94 because the first member first end 126*b* has moved within the lock bolt recess 112*b* but has not been rotated. As the bolt retraction gear 68 continues to retract the lock bolt 112, the recesses 112*b* force the first members 126 to rotate to the position shown in FIG. 14C. Once the lock bolt 112 has been fully retracted in that position, the drive rods 128 have transferred the motion of the first members 126 to the blocking members 124 to reveal the mounting bolts 94. As the spindle gear 78 drives the bolt retraction gear 68 and lock bolt 112 back to an extended or locked position, the first members 126 again engage the lock bolt recesses 112*b* and rotate back to the position in FIG. 14A. Thus, the retracting bolt shield 114 prevents an unauthorized person attempting to tamper with the lock 110 by removing the mounting bolts 94.

In a similar non-illustrated embodiment, the retracting bolt shield 114 could include a second pair of blocking members coupled for rotation with the bolt-side blocking members 124 through a simple linkage. In that embodiment, the bolt-side blocking members 124 would conceal the mounting bolts 94 on one side of the lock 110 when the lock bolt 112 is extended and the second pair of blocking members would conceal the mounting bolts 94 on the opposite side of the lock 110 when the lock bolt is retracted. Thus, an unauthorized person would need to be able to operate the lock 110 using the combination in order to have access to all four mounting bolts 94.

Figure 15A:
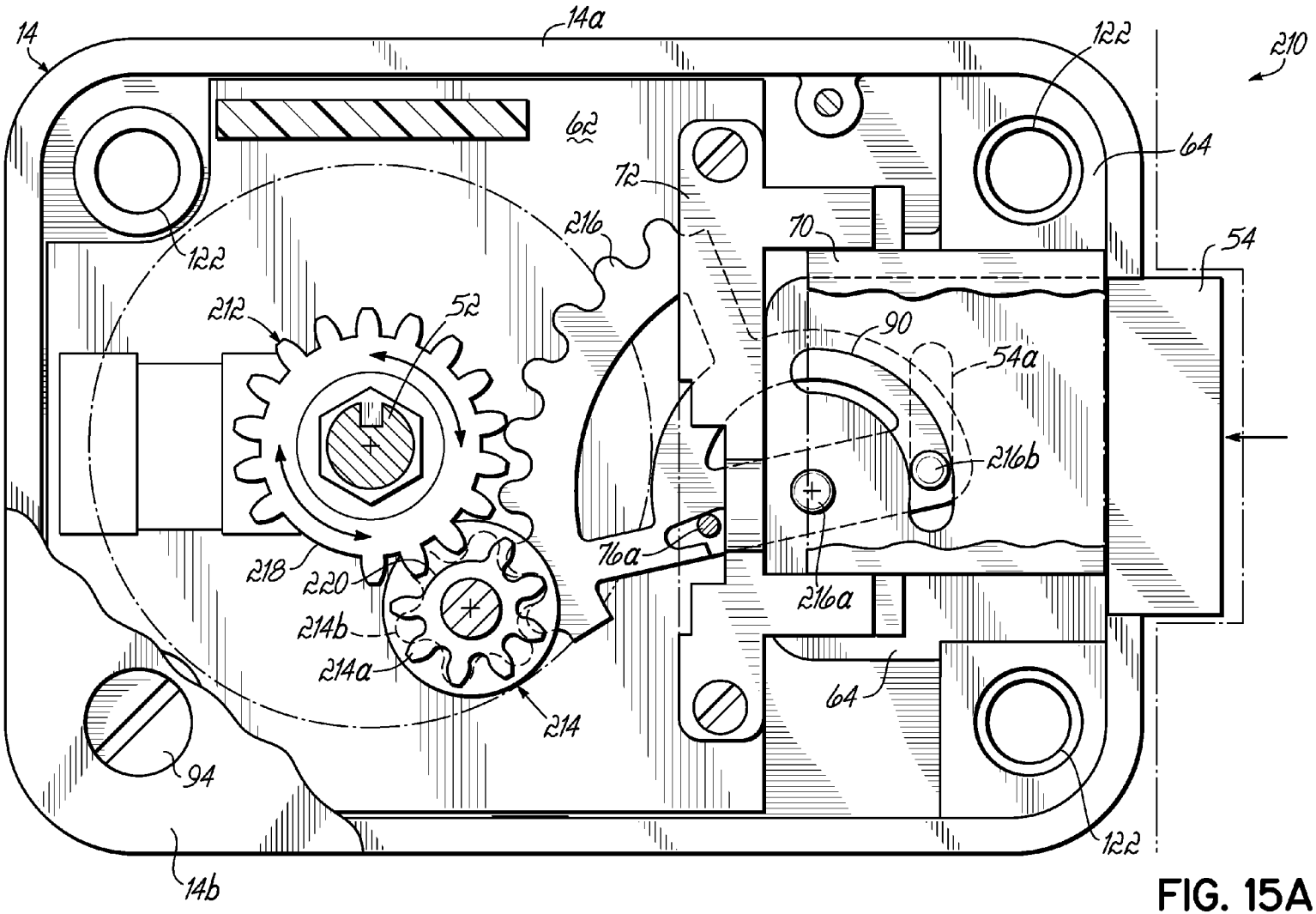
FIG. 15A is an elevational view partially broken away of another alternative embodiment of the lock, illustrating the bolt retraction hardware with the bolt in an extended or locked position.
Figure 15B:
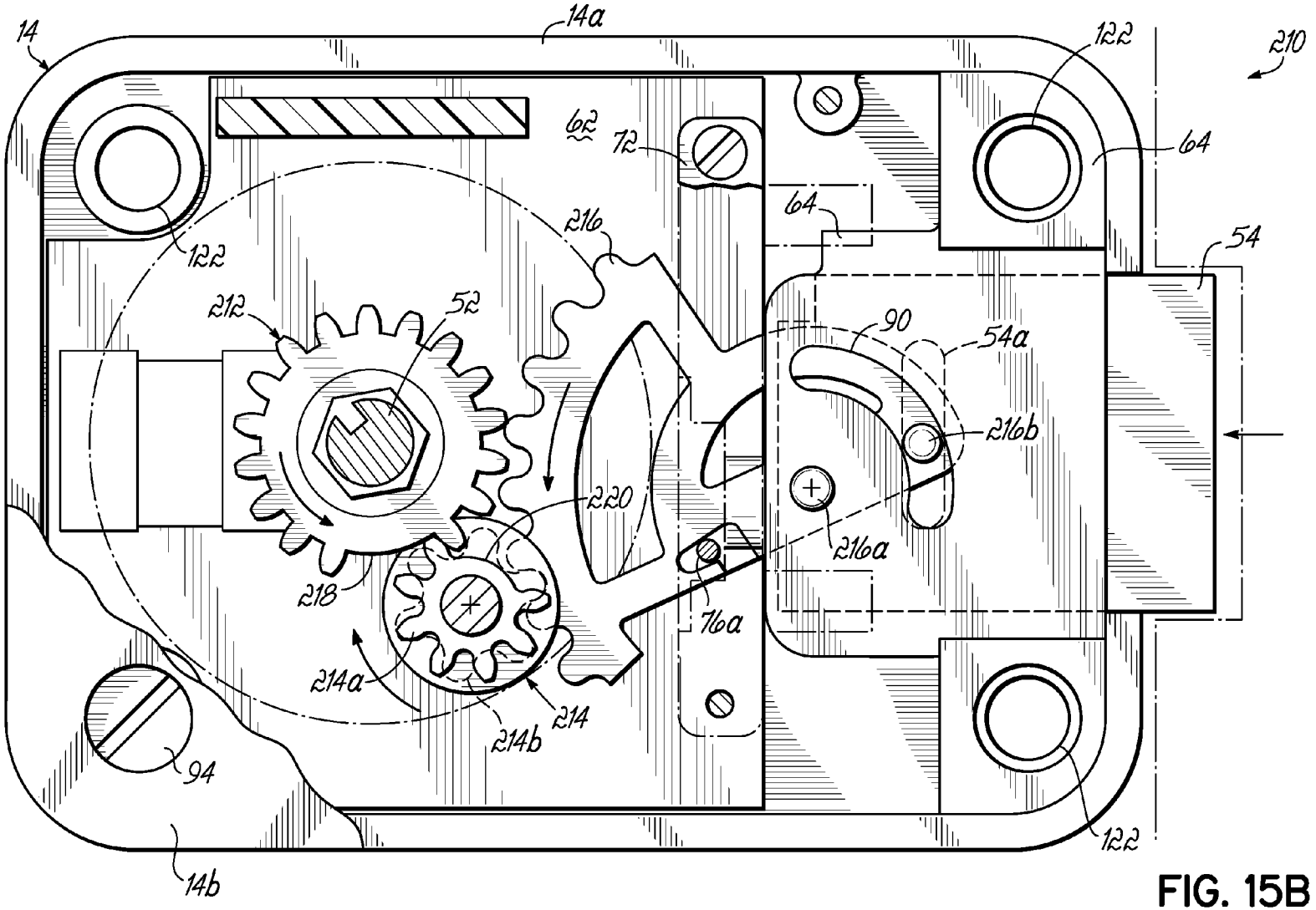
FIG. 15B is an elevational view similar to FIG. 15A, illustrating an initial portion of the bolt retraction sequence.
Figure 15C:
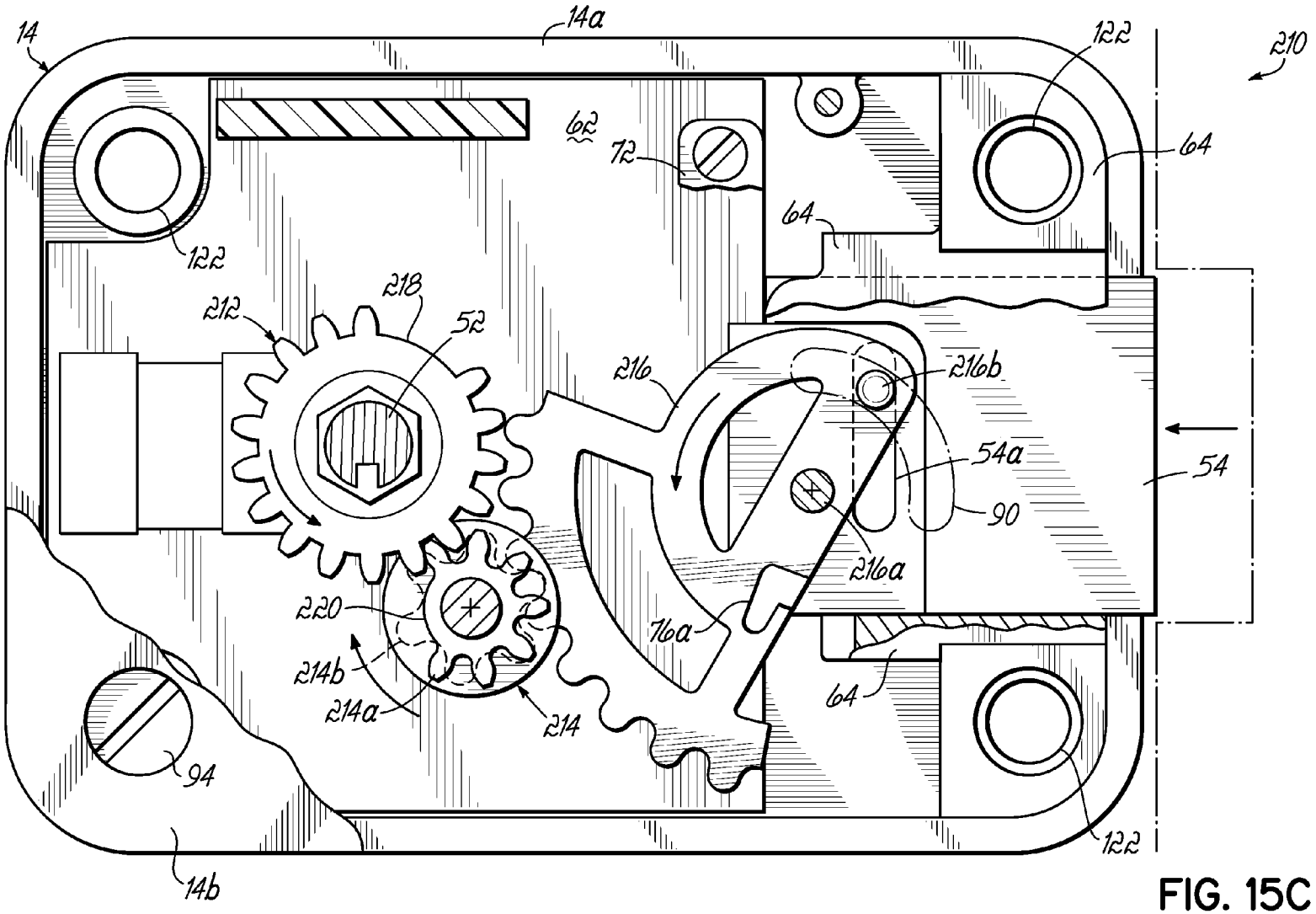
FIG. 15C is an elevational view similar to FIG. 15A, illustrating the fully retracted position of the bolt and associated bolt retraction hardware.

With reference to FIGS. 15A-15C, an additional embodiment of the lock 210 is illustrated. The lock 210 operates a bolt retraction sequence substantially similar to the above described bolt retraction sequence shown in FIGS. 8A-9C, with some modifications. The lock 210 includes a spindle gear 212, a drive gear 214 having a first drive gear portion 214*a* adapted to engage the spindle gear 212 and a second drive gear portion 214*b*, and a bolt retraction gear 216 adapted to engage the second drive gear portion 214*b*. Like the previous embodiments, the bolt retraction gear 216 includes a pivot axis 216*a* and a pin 216*b* which rides in corresponding slots 54*a*, 90 of the lock bolt 54 and the bolt guide member 64. Unlike the previous embodiments, the bolt retraction gear 216 remains engaged with the second drive gear portion 214*b* when the lock bolt 54 is fully extended as shown in FIG. 15A. A two-tooth relief 218 is provided on the spindle gear 212 and a corresponding two-tooth relief 220 is provided on the first drive gear portion 214*a*. The relief 220 in the first drive gear portion 214*a* is oriented as shown in FIG. 15A to prevent engagement of the spindle gear 212 and the drive gear 214 while the spindle gear 212 is rotated during combination entry. Thus, no audible information from gear collisions is provided to an unauthorized person rotating the dial 24.

Once a correct combination has been entered, the actuator 70 does not immediately rotate the output pin 76*a* out of the path of the bolt retraction gear 216. Instead, the controller waits until the spindle gear 212 has been rotated to the position shown in FIG. 15B, wherein the relief 218 on the spindle gear 212 is positioned facing towards the drive gear 214. At this position, the controller sends the signal to the actuator 70 to rotate output element 76 and pin 76*a* out of the path of bolt retraction gear 216 as previously illustrated in FIGS. 9A-9C. The bolt retraction gear 216 then rotates slightly downwards as shown in FIG. 15B, thereby rotating the drive gear 214 and moving the teeth of the first drive gear portion 214*a* into position for meshing with the spindle gear 212. As the spindle gear 212 continues to rotate with the dial 24, the first drive gear portion 214*a* is driven to the location shown in FIG. 15C, which also translates through the second drive gear portion 214*b* into downward rotation of the bolt retraction gear 216. Furthermore, the pin 216*b* forces the lock bolt 54 to retract in the position shown in FIG. 15C, thus completing the bolt retraction sequence of the lock 210.

Figure 16A:
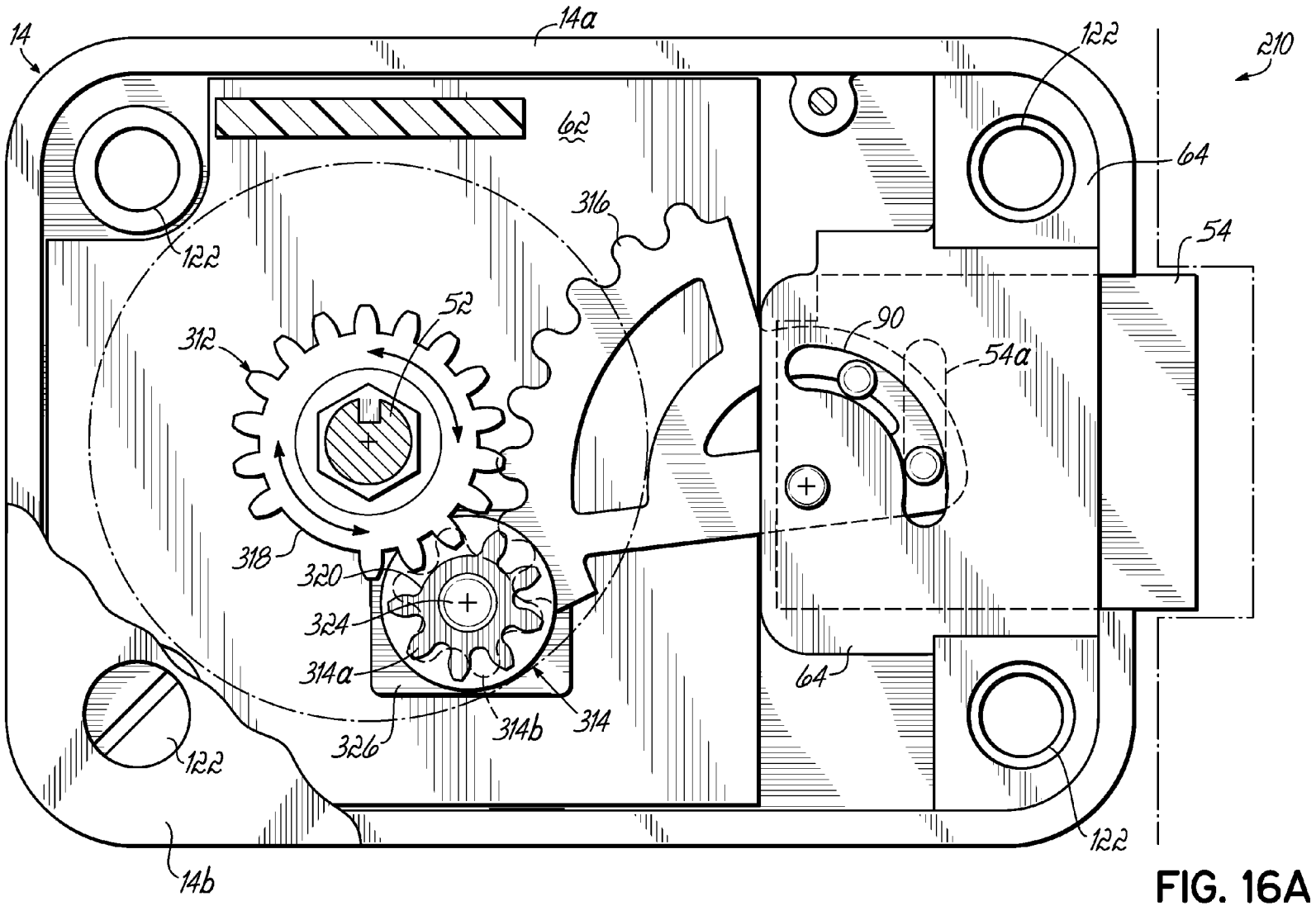
FIG. 16A is an elevational view partially broken away of an alternative embodiment of the lock, illustrating the bolt retraction hardware with the bolt in an extended or locked position.

An additional embodiment of the lock 310 is illustrated in FIGS. 16A-17C. The lock 310 is similar to the lock 210 of the previous embodiment and includes a spindle gear 312, a drive gear 314 having a first drive gear portion 314*a* adapted to engage the spindle gear 312 and a second drive gear portion 314*b*, and a bolt retraction gear 316 adapted to engage the second drive gear portion 314*b*. The spindle gear 312 and first drive gear portion 314*a* are also provided with corresponding two-tooth reliefs 318, 320 in the same manner as explained above with respect to lock 210. In this embodiment of the lock 310, the actuator 70 and associated output element 76 have been removed. The second drive gear portion 314*b* includes a two-tooth relief 322 that is adapted to prevent engagement of the bolt retraction gear 316 and the second drive gear portion 314*a* when the lock bolt 54 is fully extended as shown in FIGS. 16A and 17A. The bolt retraction gear 316 is initially positioned in a similar location as the previous embodiment, with gear teeth facing the second drive gear portion 314*b* for engagement.

Figure 16B:
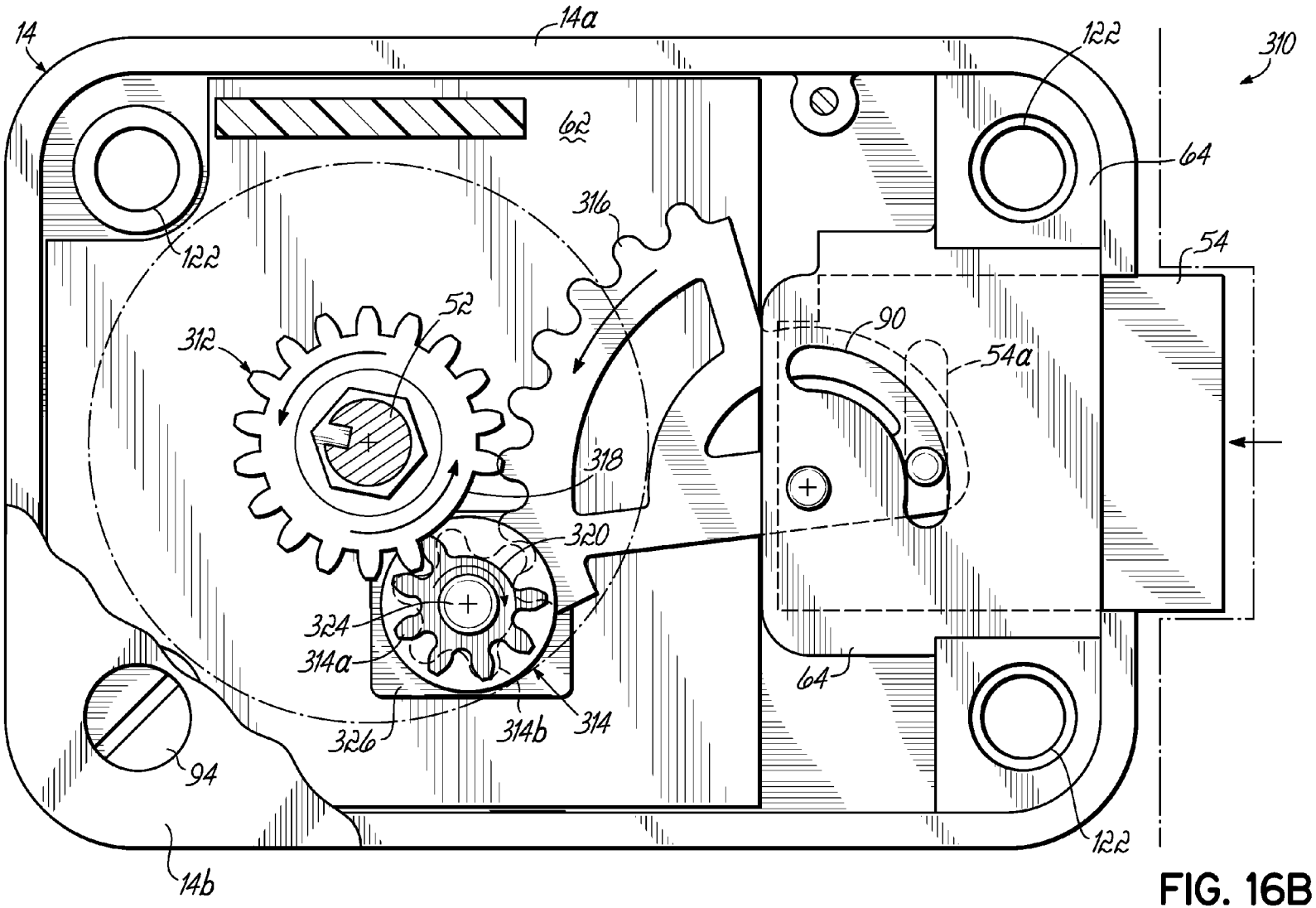
FIG. 16B is an elevational view similar to FIG. 16A, illustrating an initial portion of the bolt retraction sequence.
Figure 16C:
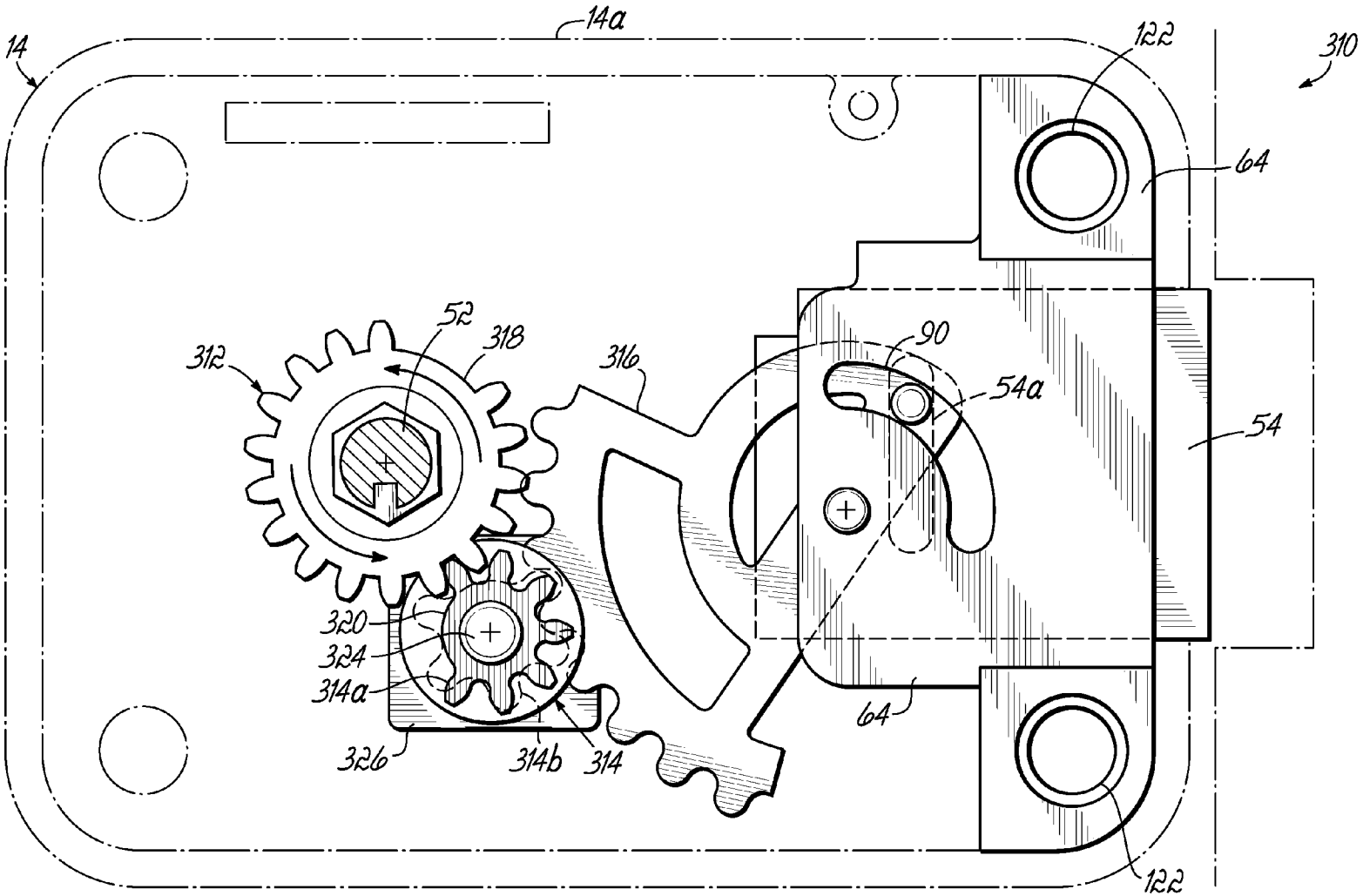
FIG. 16C is an elevational view similar to FIG. 16A, illustrating the fully retracted position of the bolt and associated bolt retraction hardware.
Figure 17A:
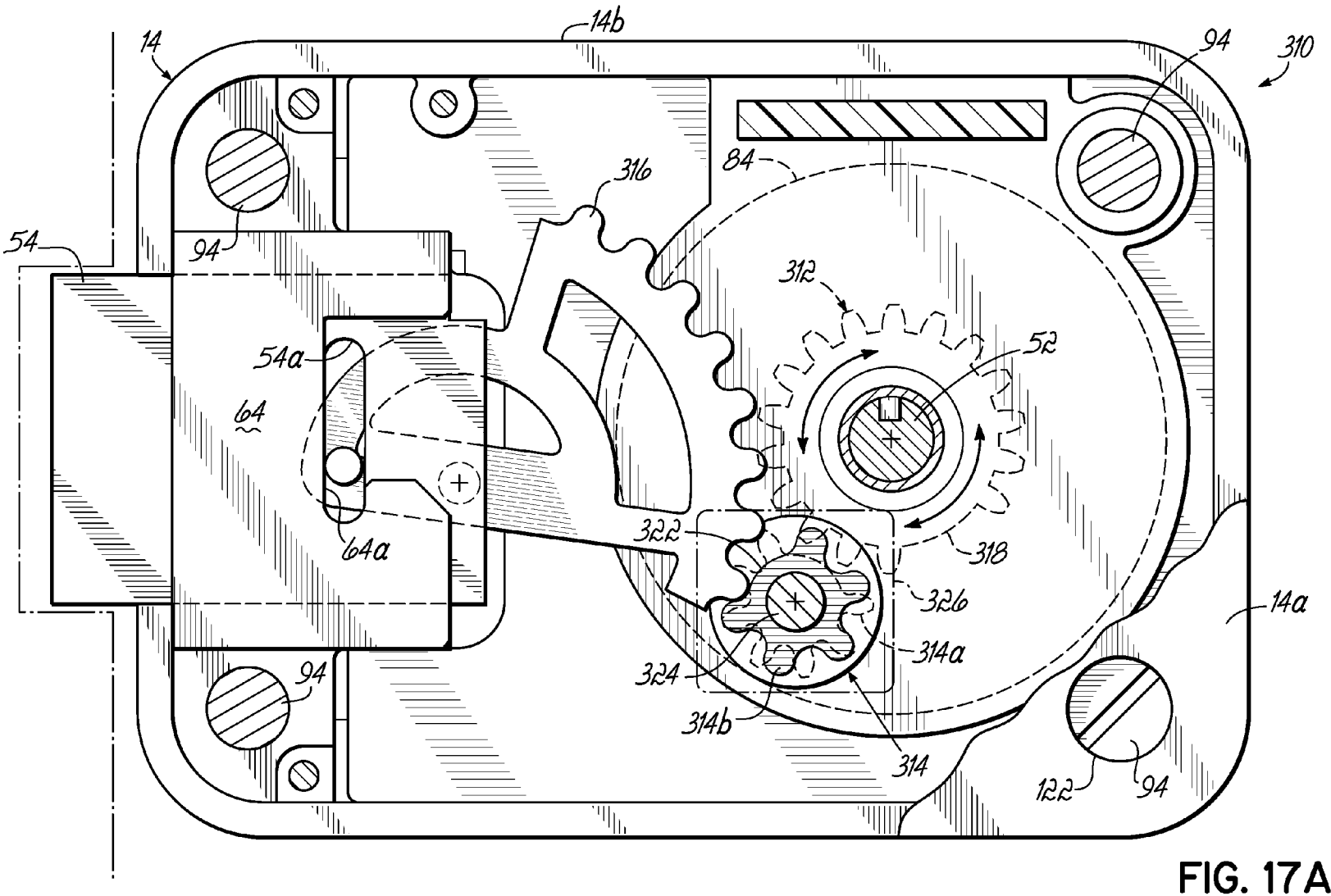
FIG. 17A is a reverse elevational view partially broken away of the lock of FIG. 16A, illustrating the bolt retraction hardware with the bolt in an extended or locked position.
Figure 17B:
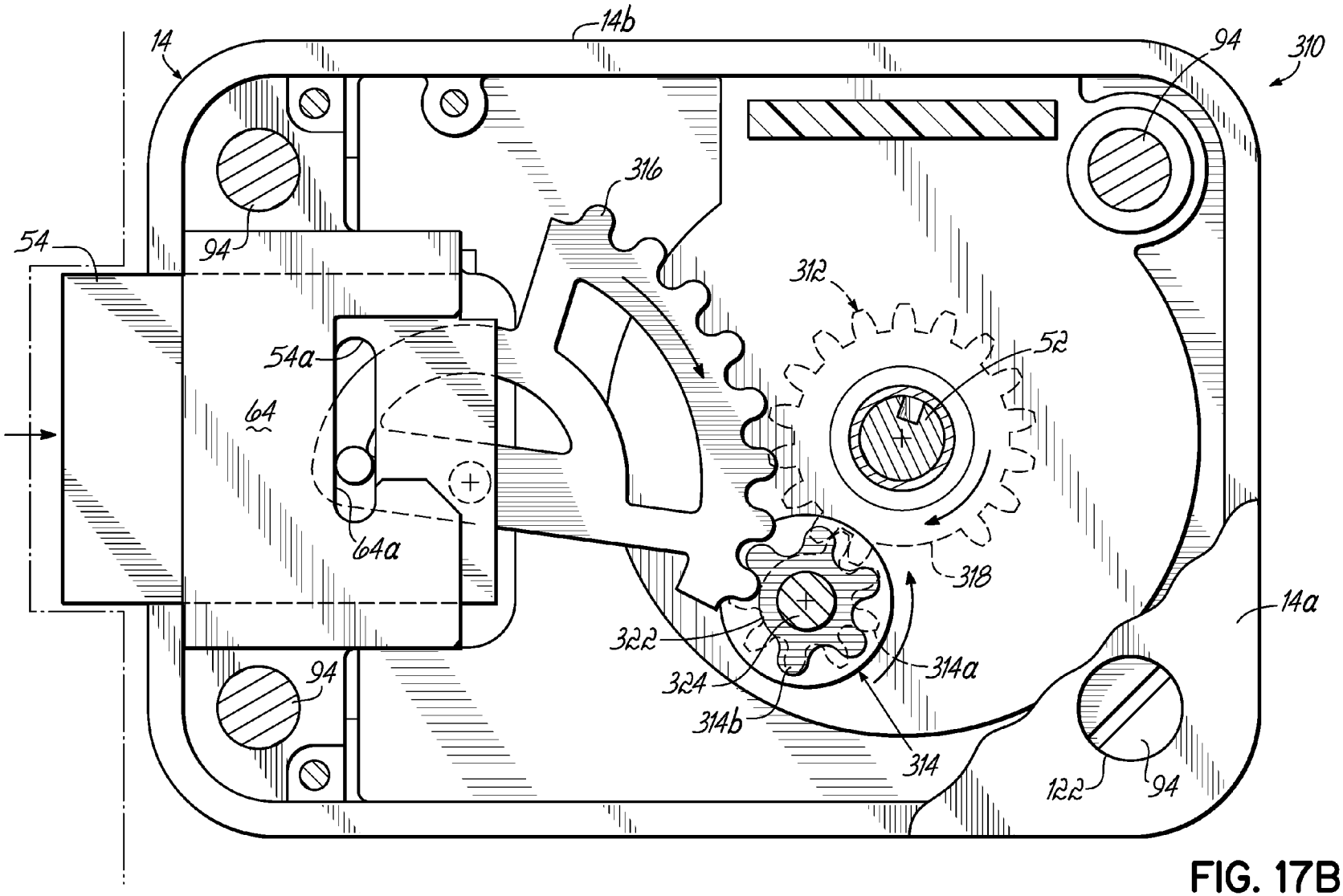
FIG. 17B is a reverse elevational view similar to FIG. 16A, illustrating an initial portion of the bolt retraction sequence.
Figure 17C:
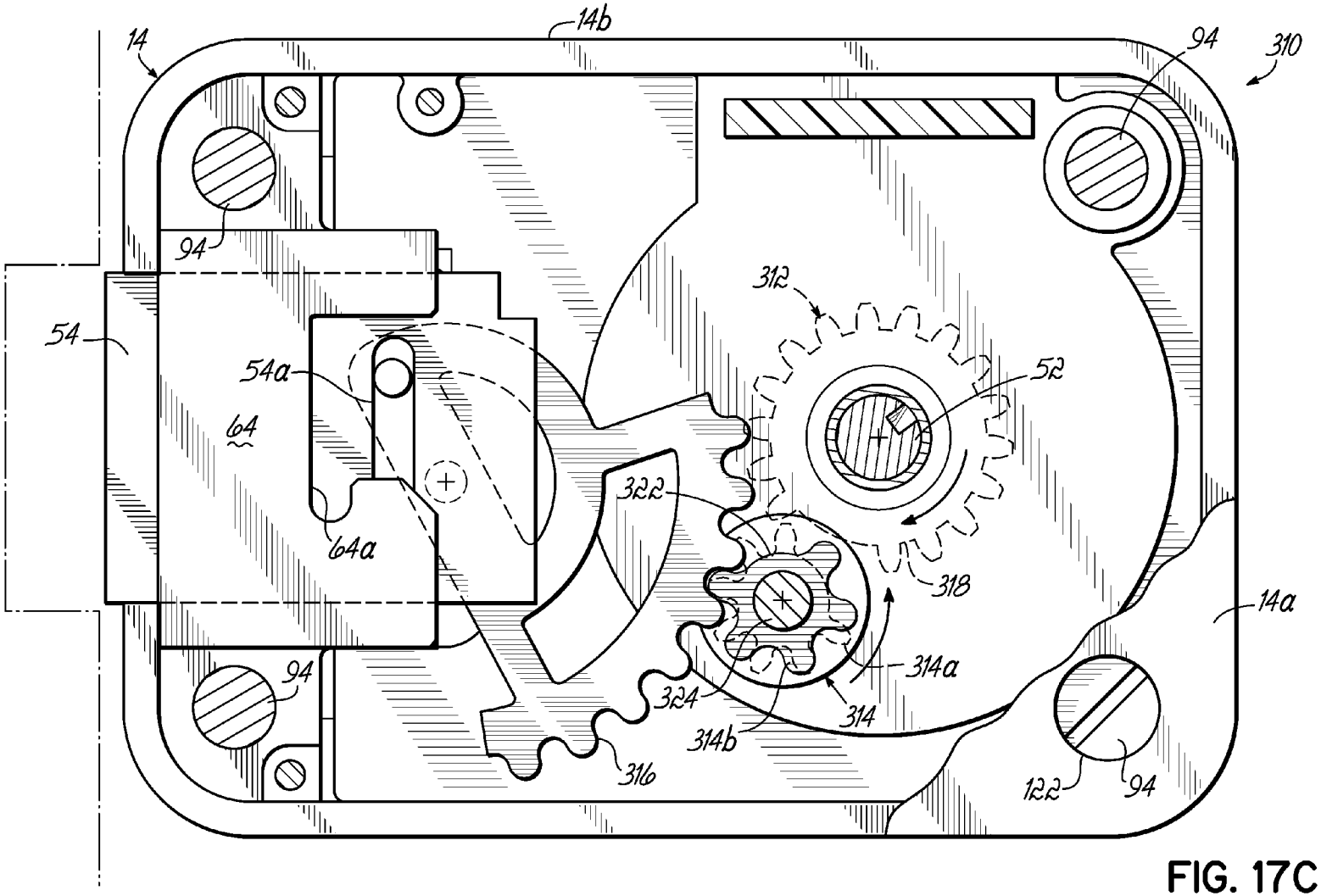
FIG. 17C is a reverse elevational view similar to FIG. 16A, illustrating the fully retracted position of the bolt and associated bolt retraction hardware.

When the lock bolt 54 is fully extended, the orientation of the reliefs 320, 322 on opposing drive gear portions 314*a*, 314*b* is set to disengage the drive gear 314 from both the spindle gear 312 and the bolt retraction gear 316. The drive gear 314 of the current embodiment is mounted on an input shaft 324, and an actuator 326 is operatively coupled to the drive gear 314 at the opposing end of the shaft 324. The actuator 326 is located proximate to the circuit board 62 and is adapted to rotate the shaft 324 and the drive gear 314. The actuator 326 is a low-powered driving device such as a geared servo motor, a non-geared servo motor, or an air core rotary solenoid. When a proper combination has been entered into the lock 310, the circuit board 62 waits until the dial 24 is rotated such that the relief 318 in the spindle gear 312 faces the first drive gear portion 314*a* as shown in FIGS. 16B and 17B. Then the circuit board 62 sends a signal to the actuator 326, causing the shaft 324 and the drive gear 314 to rotate into engagement with both the spindle gear 312 and the bolt retraction gear 316 simultaneously as shown in FIGS. 16B and 17B. As the user continues to rotate the dial 24, the spindle gear 312 drives the drive gear 314 and the bolt retraction gear 316 to the position shown in FIGS. 16C and 17C, wherein the lock bolt 54 has been fully retracted. This embodiment of the lock 310 also removes all audible noise from gear engagement or collisions during combination entry, and the actuator 326 requires as little as 10% of the operating energy as the servo motor 70 of previous embodiments. Therefore, this embodiment of the lock 310 further thwarts unauthorized entry through the door.

Figure 18:
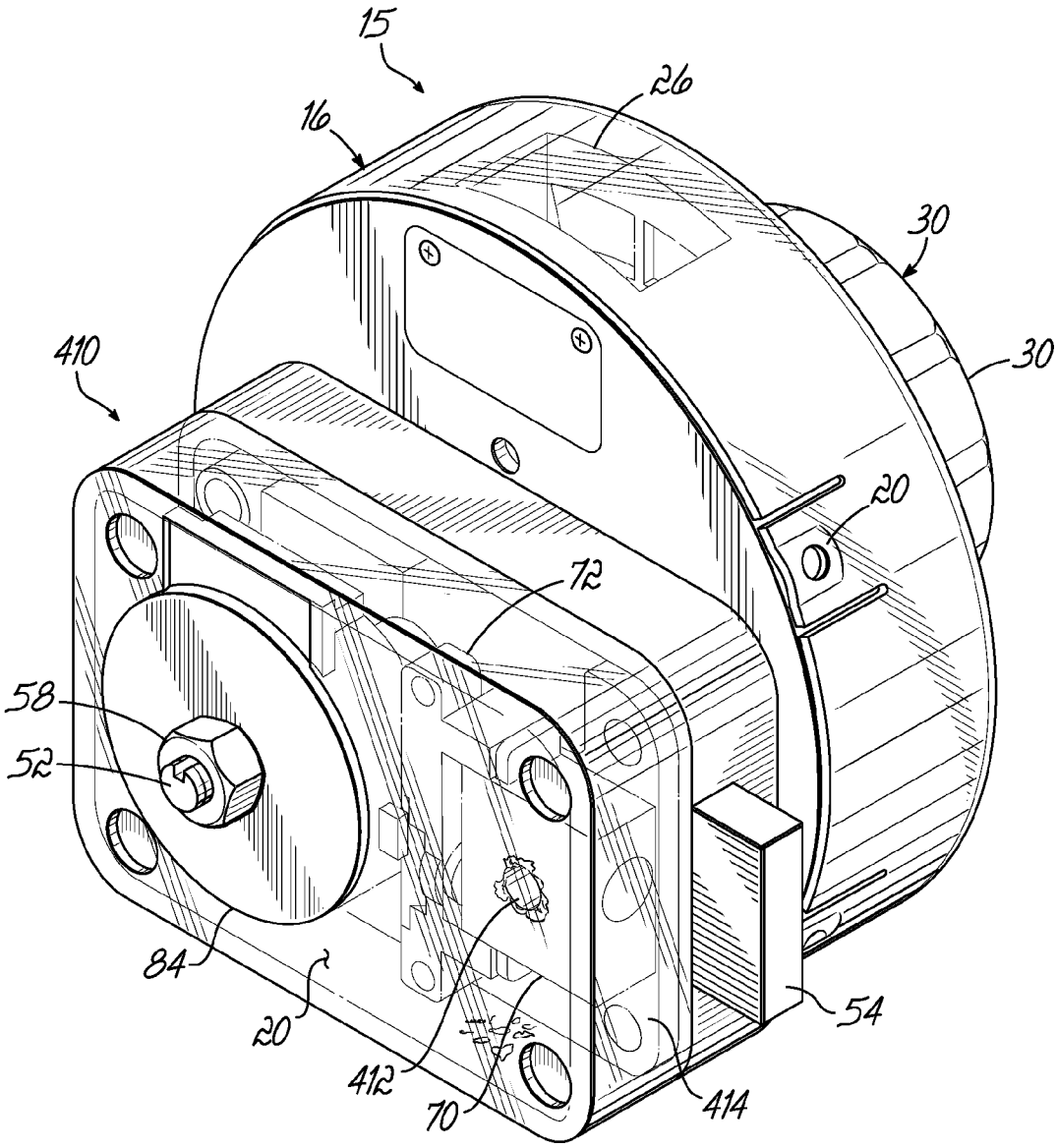
FIG. 18 is a rear perspective view of another alternative embodiment of the lock, illustrating visible damage from unauthorized tampering with the lock case.

Referring to FIG. 18, an alternative embodiment of the lock 410 is illustrated. The lock 410 includes a lock casing 414 formed of substantially translucent material such that the interior components of the lock 410 are visible from the outside of the lock casing 414. In the event of an unauthorized entry into the lock casing 414 or an attempt to break the lock 410, the translucent lock casing 414 will clearly show evidence of the attempted entry as shown in FIG. 18. A drilled hole 412 through the casing 414 is visible proximate to the lock bolt 54. Unlike an opaque lock casing, the drilled hole 412 in the translucent lock casing 414 cannot be patched or filled with material to conceal the attempted entry without detection by a person inspecting the rear side 56 of the lock casing 414. Furthermore, an inspection of the lock 410 through the translucent lock casing 414 will reveal any internal tampering or problems with the components of the lock 410. One having skill in the art will appreciate that the translucent casing 414 of the current embodiment can be used with any of the previous embodiments described to further discourage unauthorized tampering with the lock.

Figure 19A:
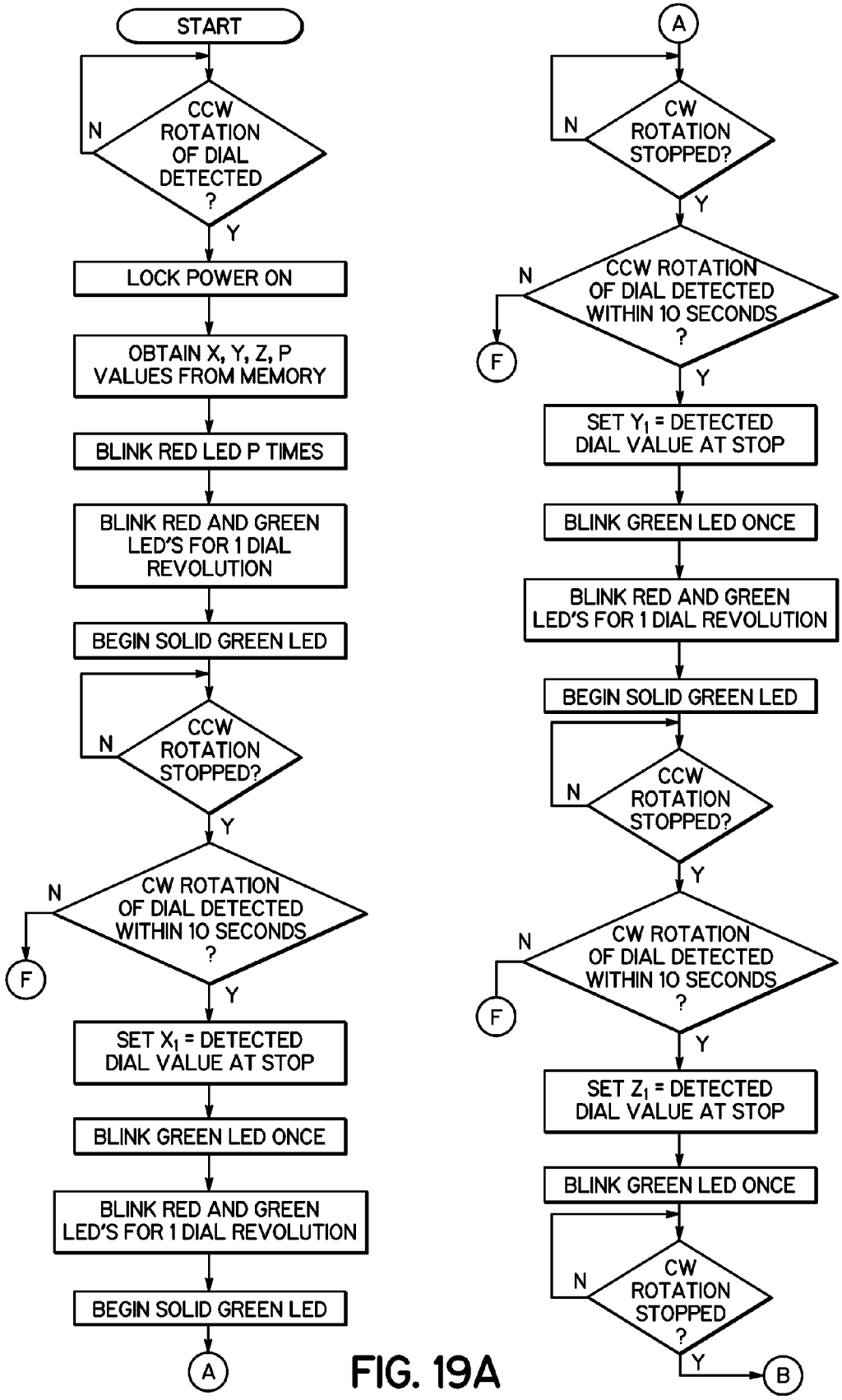
FIGS. 19A and 19B are a flowchart illustrating the control logic of the operational mode for one embodiment of the lock.
Figure 19B:
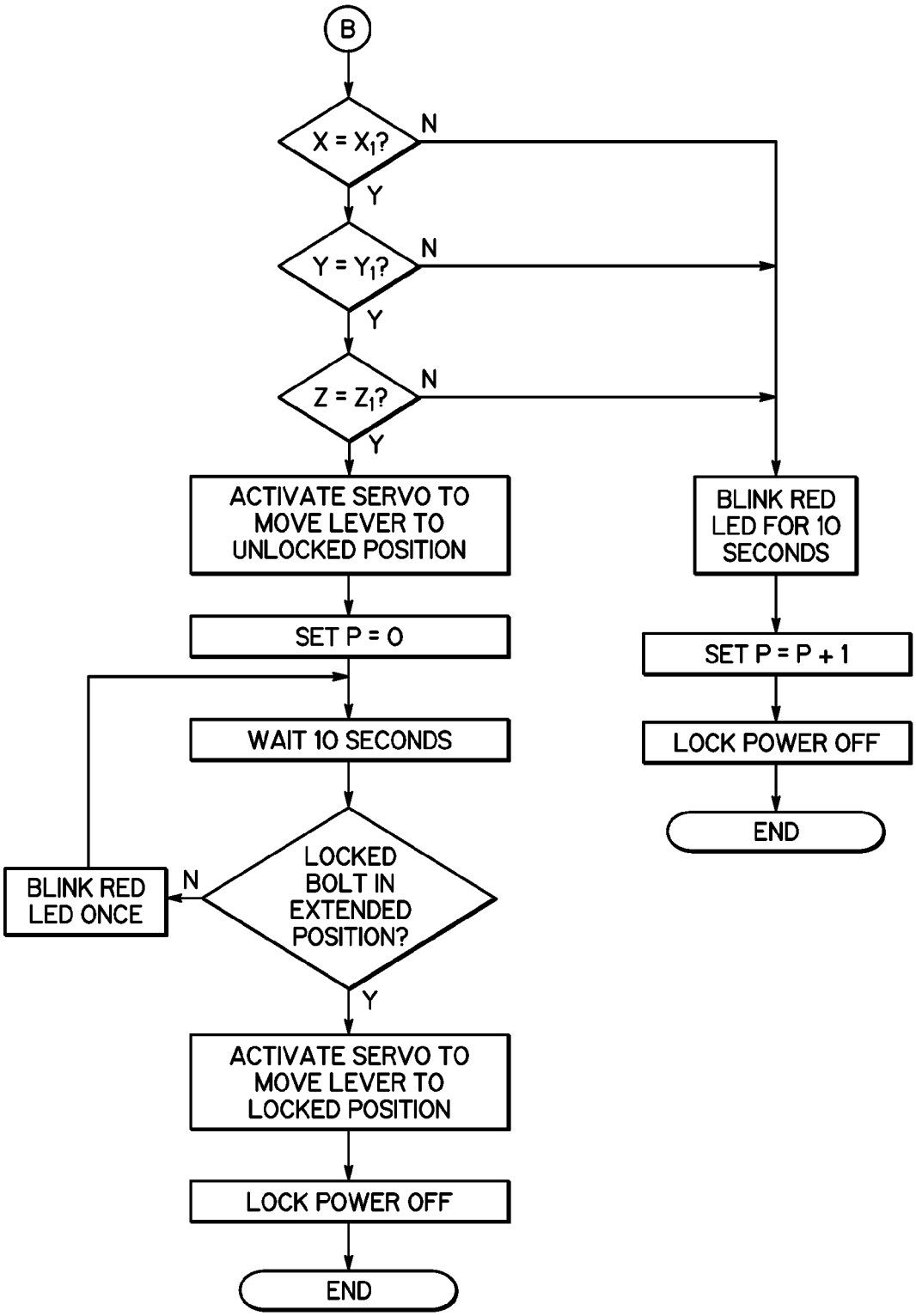
Figure 20:
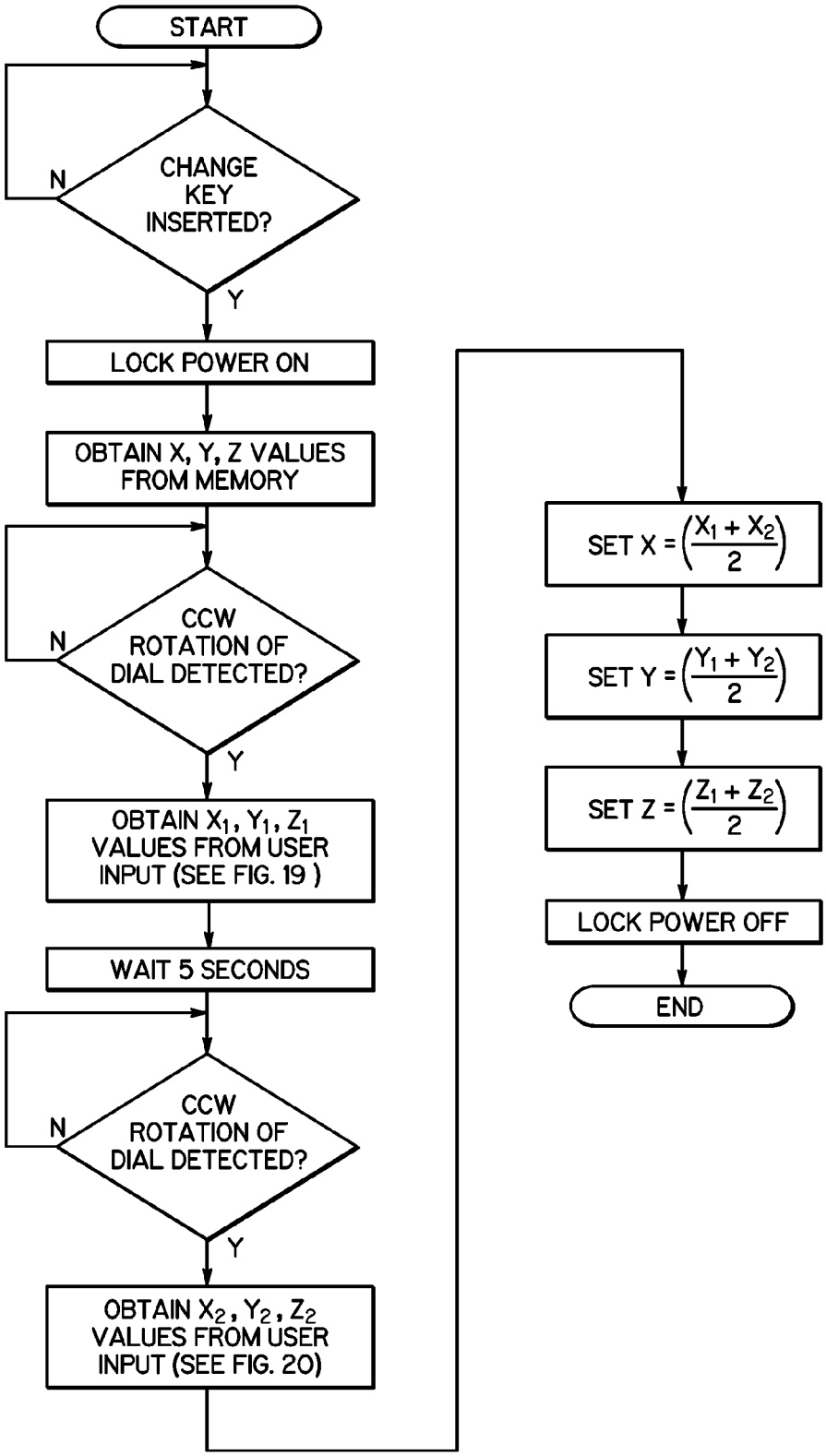
FIG. 20 is a flowchart illustrating the control logic of the configuration mode for one embodiment of the lock.

For each of the embodiments of lock 10, 110, 210, 310, 410 having a lock dial 24 for the user input device 15 as described above, the circuit board 62 and encoder 84 are programmed to control the lock 10 by a specific set of operating instructions diagrammed in FIGS. 19A-20. In the operational mode of FIGS. 19A and 19B, once a counterclockwise rotation of the lock dial 24 is detected, the lock power activates and obtains authentication information or the proper combination values X, Y, Z from memory along with a value P that represents the number of incorrect combination entries attempted since the last unlocking of the lock. The LED 46 will blink red P times to allow the authorized users of the lock to know when other persons have unsuccessfully attempted to break through the door 12. After these penalty blinks, the LED 46 will blink red and green for one dial revolution and then turn solid green. Once the controller detects that counterclockwise rotation has stopped and clockwise rotation has begun, then the controller stores the entered dial value at the stop as $X_1$ and repeats the process to obtain $Y_1$ and $Z_1$ values. Then the controller verifies if the entered dial values $X_1$, $Y_1$, $Z_1$ match the proper combination values X, Y, Z. If the values do not match, the LED 46 blinks red for 10 seconds and the P value is increased by 1 before the lock 10 power deactivates. If the values do match, then the servo motor 70 or actuator 326 is engaged to allow the bolt 54 to be retracted, and the P value is set to zero. As long as the lock bolt 54 remains in the opened or retracted position, the LED 46 will blink red once every ten seconds to indicate that the lock 10 is in the open position. Once the lock bolt 54 is moved back to the extended position, the lock power is deactivated.

Referring to FIG. 20, a configuration mode is activated when a change key is inserted into the lock 10. The lock power activates and obtains the proper combination values X, Y, Z from memory. Once a counterclockwise rotation of the dial is detected, the lock follows the procedure described above in FIGS. 19A and 19B to obtain user input values $X_1$, $Y_1$, $Z_1$. After a five second pause, the process of obtaining user input repeats and values $X_2$, $Y_2$, $Z_2$ are stored. Then the controller sets the proper combination values X, Y, Z equal to the average of the two sets of user input values. Consequently, the configuration mode verifies that the desired new combination is set correctly.

A person having skill in the art will recognize that the various embodiments of the lock 10, 110, 210, 310, 410 can be operated with alternative user input devices 15 instead of the mechanical lock dial 24. For example, an electronic keypad could be positioned on the outside of the door 12 for electronic entry of combination values. Alternatively, the user input device 15 could include a fingerprint or retinal scan verification device. The internal components of the lock 10 positioned within the lock casing 14 operate as described above regardless of the chosen user input device 15.

While the present invention has been illustrated by a description of several embodiments, and while such embodiments have been described in considerable detail, there is no intention to restrict, or in any way limit, the scope of the appended claims to such detail. Additional advantages and modifications will readily appear to those skilled in the art. For example, the configuration mode detailed in FIG. 20 may be modified to require three sets of user input values to average together in order to set a new combination. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

The invention claimed is:

1. A locking mechanism comprising:

a lock bolt movable between extended and retracted positions;

a bolt retraction gear operatively coupled to the lock bolt and movable between engagement and disengagement positions, the bolt retraction gear being biased towards the engagement position;

a manually-driven gear train adapted to engage the bolt retraction gear in the engagement position and drive the lock bolt between the extended and retracted positions;

a user input device adapted to receive user input information;

a controller adapted to store authorization information and verify user input information; and an actuator having a rotatable output element, the rotatable output element blocking movement of the bolt retraction gear towards the engagement position until the controller verifies that the user input information matches the stored authorization information.

2. The locking mechanism of claim 1, wherein the user input device is a rotatable lock dial and the authorization information is a numerical combination.

3. The locking mechanism of claim 2, further comprising a spindle shaft coupling the rotatable lock dial to the manually-driven gear train, wherein the lock dial is rotated to enter user input information and to move the lock bolt from the extended position to the retracted position when the user input information is verified.

4. The locking mechanism of claim 1, wherein the manually-driven gear train comprises a manually driven-spindle gear and a drive gear.

5. The locking mechanism of claim 4, wherein the drive gear comprises a first drive gear portion engaged with the spindle gear and an opposing second drive gear portion adapted to be engaged with the bolt retraction gear in the engagement position.

6. The locking mechanism of claim 1, wherein the bolt retraction gear further comprises a slot and the rotatable output element further comprises a blocking pin, the blocking pin disposed in the slot of the bolt retraction gear in the disengagement position to block movement of the bolt retraction gear.

7. The locking mechanism of claim 6, wherein the rotating output element slides the blocking pin out of the slot in the bolt retraction gear as the actuator moves the bolt retraction gear from the disengagement position to the engagement position.

8. The locking mechanism of claim 7, wherein the actuator is a servo motor.

9. The locking mechanism of claim 1, wherein the lock bolt further comprises a slot and the bolt retraction gear further comprises a pivot and a retraction pin, the retraction pin sliding along the slot in the lock bolt as the bolt retraction gear rotates about the pivot to retract and extend the lock bolt.

10. The locking mechanism of claim 1, further comprising a lock casing surrounding the actuator, controller, manually-driven gear train, and the bolt retraction gear, the lock bolt flush with the lock casing in the retracted position.

11. The locking mechanism of claim 10, further comprising a lock bolt extension coupled to the lock bolt, the combined lock bolt and extension projecting beyond the lock casing in the retracted position.

12. The locking mechanism of claim 10, wherein the lock casing is at least partially translucent to reveal evidence of unauthorized drilling into the lock bolt casing.

13. The locking mechanism of claim 12, wherein the controller further comprises a circuit board, the lock casing further comprises a spindle sleeve adjacent to the circuit board, the manually-driven gear train further comprises a spindle shaft extending through the spindle sleeve outside the lock casing, and the locking mechanism further comprises:

a circuit breaker device adjacent to the spindle sleeve and wired into the controller, wherein drilling through the spindle sleeve will break the circuit breaker device and render the controller inoperative.

14. The locking mechanism of claim 13, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

15. The locking mechanism of claim 10, wherein the controller further comprises a circuit board, the lock casing further comprises a spindle sleeve adjacent to the circuit board, the manually-driven gear train further comprises a spindle shaft extending through the spindle sleeve outside the lock casing, and the locking mechanism further comprises:

a circuit breaker device adjacent to the spindle sleeve and wired into the controller, wherein drilling through the spindle sleeve will break the circuit breaker device and render the controller inoperative.

16. The locking mechanism of claim 15, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

17. The locking mechanism of claim 10, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

18. A locking mechanism comprising:

a lock bolt movable between extended and retracted positions;

a bolt retraction gear operatively coupled to the lock bolt;

a manually-driven gear train including a spindle gear and a drive gear engaged with the bolt retraction gear, the drive gear including a relief portion and movable between an engagement position with the spindle gear and a disengagement position where the relief portion faces the spindle gear, the drive gear being biased towards the engagement position by the bolt retraction gear;

a user input device adapted to receive user input information;

a controller adapted to store authorization information and verify user input information; and an actuator having a rotatable output element, the rotatable output element blocking movement of the bolt retraction gear and thereby preventing rotation of the drive gear from the disengagement position to the engagement position until the controller verifies that the user input information matches the stored authorization information.

19. The locking mechanism of claim 18, wherein the user input device is a rotatable lock dial and the authorization information is a numerical combination.

20. The locking mechanism of claim 19, further comprising a spindle shaft coupling the rotatable lock dial to the manually-driven gear train, wherein the lock dial is rotated to enter user input information and to move the lock bolt from the extended position to the retracted position when the user input information is verified.

21. The locking mechanism of claim 18, wherein the spindle gear includes a relief portion, and the actuator is adapted to move the bolt retraction gear to rotate the drive gear from the disengagement position to the engagement position only when the relief portion on the spindle gear faces the drive gear.

22. The locking mechanism of claim 18, wherein the drive gear comprises a first drive gear portion adapted to be engaged with the spindle gear and an opposing second drive gear portion engaged with the bolt retraction gear in the engagement position.

23. The locking mechanism of claim 18, wherein the bolt retraction gear further comprises a slot and the rotatable output element further comprises a blocking pin, the blocking pin disposed in the slot of the bolt retraction gear in the disengagement position to block movement of the bolt retraction gear.

24. The locking mechanism of claim 23, wherein the rotating output element slides the blocking pin out of the slot in the bolt retraction gear as the actuator moves the bolt retraction gear to rotate the drive gear from the disengagement position to the engagement position.

25. The locking mechanism of claim 24, wherein the actuator is a servo motor.

26. The locking mechanism of claim 18, wherein the lock bolt further comprises a slot and the bolt retraction gear further comprises a pivot and a retraction pin, the retraction pin sliding along the slot in the lock bolt as the bolt retraction gear rotates about the pivot to retract and extend the lock bolt.

27. The locking mechanism of claim 18, further comprising a lock casing surrounding the actuator, controller, manually-driven gear train, and the bolt retraction gear, the lock bolt flush with the lock casing in the retracted position.

28. The locking mechanism of claim 27, further comprising a lock bolt extension coupled to the lock bolt, the combined lock bolt and extension projecting beyond the lock casing in the retracted position.

29. The locking mechanism of claim 27, wherein the lock casing is at least partially translucent to reveal evidence of unauthorized drilling into the lock bolt casing.

30. The locking mechanism of claim 29, wherein the controller further comprises a circuit board, the lock casing further comprises a spindle sleeve adjacent to the circuit board, the manually-driven gear train further comprises a spindle shaft extending through the spindle sleeve outside the lock casing, and the locking mechanism further comprises:

a circuit breaker device adjacent to the spindle sleeve and wired into the controller, wherein drilling through the spindle sleeve will break the circuit breaker device and render the controller inoperative.

31. The locking mechanism of claim 30, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

32. The locking mechanism of claim 27, wherein the controller further comprises a circuit board, the lock casing further comprises a spindle sleeve adjacent to the circuit board, the manually-driven gear train further comprises a spindle shaft extending through the spindle sleeve outside the lock casing, and the locking mechanism further comprises:

a circuit breaker device adjacent to the spindle sleeve and wired into the controller, wherein drilling through the spindle sleeve will break the circuit breaker device and render the controller inoperative.

33. The locking mechanism of claim 32, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

34. The locking mechanism of claim 27, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

35. A locking mechanism comprising:

a lock bolt movable between extended and retracted positions;

a bolt retraction gear operatively coupled to the lock bolt;

a manually-driven spindle gear;

a drive gear mounted on a drive shaft and including first and second relief portions, the drive gear being movable between an engagement position where the drive gear engages both the spindle gear and the bolt retraction gear and a disengagement position where the first relief portion faces the spindle gear and the second relief portion faces the bolt retraction gear;

a user input device adapted to receive user input information;

a controller adapted to store authorization information and verify user input information;

an actuator coupled to the drive shaft and adapted to move the drive gear from the disengagement position to the engagement position such that the spindle gear can drive the lock bolt between the extended and retracted positions when the controller verifies that the user input information matches the stored authorization information;

a lock casing surrounding the actuator, controller, spindle gear, drive gear, and the bolt retraction gear, the lock bolt flush with the lock casing in the retracted position; and a lock bolt extension coupled to the lock bolt, the combined lock bolt and extension projecting beyond the lock casing in the retracted position.

36. The locking mechanism of claim 35, wherein the user input device is a rotatable lock dial and the authorization information is a numerical combination.

37. The locking mechanism of claim 36, further comprising a spindle shaft coupling the rotatable lock dial to the manually-driven gear train, wherein the lock dial is rotated to enter user input information and to move the lock bolt from the extended position to the retracted position when the user input information is verified.

38. The locking mechanism of claim 35, wherein the spindle gear includes a relief portion, and the actuator is adapted to move the drive gear from the disengagement position to the engagement position only when the relief portion on the spindle gear faces the drive gear.

39. The locking mechanism of claim 35, wherein the drive gear comprises a first drive gear portion including the first relief portion and adapted to be engaged with the spindle gear, and an opposing second drive gear portion including the second relief portion and engaged with the bolt retraction gear in the engagement position.

40. The locking mechanism of claim 35, wherein the lock bolt further comprises a slot and the bolt retraction gear further comprises a pivot and a retraction pin, the retraction pin sliding along the slot in the lock bolt as the bolt retraction gear rotates about the pivot to retract and extend the lock bolt.

41. The locking mechanism of claim 35, wherein the lock casing is at least partially translucent to reveal evidence of unauthorized drilling into the lock bolt casing.

42. The locking mechanism of claim 41, wherein the controller further comprises a circuit board, the lock casing further comprises a spindle sleeve adjacent to the circuit board, the manually-driven gear train further comprises a spindle shaft extending through the spindle sleeve outside the lock casing, and the locking mechanism further comprises:

a circuit breaker device adjacent to the spindle sleeve and wired into the controller, wherein drilling through the spindle sleeve will break the circuit breaker device and render the controller inoperative.

43. The locking mechanism of claim 42, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

44. The locking mechanism of claim 35, wherein the controller further comprises a circuit board, the lock casing further comprises a spindle sleeve adjacent to the circuit board, the manually-driven gear train further comprises a spindle shaft extending through the spindle sleeve outside the lock casing, and the locking mechanism further comprises:

a circuit breaker device adjacent to the spindle sleeve and wired into the controller, wherein drilling through the spindle sleeve will break the circuit breaker device and render the controller inoperative.

45. The locking mechanism of claim 44, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

46. The locking mechanism of claim 35, wherein the lock casing further comprises a mounting bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

47. A locking mechanism comprising:

a lock casing having a front surface and a spindle sleeve extending inwardly from the front surface;

a lock bolt disposed at least partially within the lock casing and movable between extended and retracted positions;

a manually-driven gear train adapted to be operatively coupled to the lock bolt, the gear train including a spindle shaft extending through the spindle sleeve and outside the lock casing;

a controller including a circuit board adjacent to the front surface of the lock casing and having operational circuits controlling the coupling of the manually-driven gear train to the lock bolt; and a circuit breaker device adjacent to the spindle sleeve and wired into the operational circuits of the controller, wherein drilling through the spindle sleeve will break the circuit breaker device and render the operational circuits of the locking mechanism inoperative.

48. The locking mechanism of claim 47, wherein the spindle sleeve includes an outer surface, and the circuit breaker device comprises at least one wire positioned on the outer surface of the spindle sleeve.

49. The locking mechanism of claim 48, wherein the circuit breaker device comprises a coil of wire positioned on the outer surface of the spindle sleeve.

50. The locking mechanism of claim 49, wherein the circuit breaker device is disposed around the spindle sleeve.

51. The locking mechanism of claim 48, wherein the circuit breaker device comprises a plurality of wires positioned on the outer surface of the spindle sleeve.

52. The locking mechanism of claim 47, wherein the lock casing is at least partially translucent to reveal evidence of unauthorized drilling into the lock bolt casing.

53. The locking mechanism of claim 52, wherein the lock casing has at least one mounting bolt disposed in a bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

54. The locking mechanism of claim 47, wherein the lock casing has at least one mounting bolt disposed in a bolt receptacle, the lock bolt includes a recess, and the locking mechanism further comprises:

a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

55. A locking mechanism comprising:

a lock casing having at least one mounting bolt disposed in a bolt receptacle;

a lock bolt including a recess and disposed at least partially within the lock casing, the lock bolt movable between extended and retracted positions; and a retracting bolt shield including a first member coupled to a blocking member, the blocking member movable between a blocking position over the mounting bolt in the bolt receptacle to a non-blocking position outside of the bolt receptacle, the first member disposed within the lock bolt recess and adapted to drive the blocking member from the blocking position to the non-blocking position as the lock bolt moves from the extended position to the retracted position.

56. The locking mechanism of claim 55, wherein the retracting bolt shield further comprises a drive rod coupled to the first member and the blocking member.

57. The locking mechanism of claim 56, wherein the drive rod translates motion of the first member to motion of the blocking member as the lock bolt moves from the extended position to the retracted position.

58. The locking mechanism of claim 57, wherein the first member and the blocking member rotate about the drive rod.

59. The locking mechanism of claim 55, wherein the lock casing includes a first mounting bolt disposed in a first bolt receptacle and a second mounting bolt disposed in a second bolt receptacle, and the retracting bolt shield includes a second blocking member coupled to the first member, the second blocking member movable between a blocking position over the second mounting bolt in the second bolt receptacle to a non-blocking position outside of the second bolt receptacle, the first member adapted to drive the second blocking member from the blocking position to the non-blocking position as the lock bolt moves from the retracted position to the extended position.

60. The locking mechanism of claim 55, wherein the lock casing is at least partially translucent to reveal evidence of unauthorized drilling into the lock bolt casing.

61. A method of operating a lock including a user input device, a manually-driven gear train, a bolt retraction gear biased towards engagement with the manually-driven gear train, a lock bolt engaged with the bolt retraction gear, a blocking member, and a controller, the method comprising:

blocking the bolt retraction gear with the blocking member to prevent engagement of the bolt retraction gear with the manually-driven gear train;

recording user input information from the user input device;

verifying that the user input information matches authorization information stored in the controller;

disengaging the blocking member from the bolt retraction gear to permit engagement of the bolt retraction gear with the manually-driven gear train after the user input information has been verified; and driving the lock bolt to a retracted position by manually driving the gear train and the bolt retraction gear.

62. The method of claim 61, wherein the lock further includes a retractable bolt shield and at least one mounting bolt in a bolt receptacle, the method further comprising:

driving the lock bolt to an extended position by manually driving the gear train and the bolt retraction gear; and sliding the retractable bolt shield over the mounting bolt in the bolt receptacle as the lock bolt moves from the retracted position to the extended position.

63. The method of claim 62, wherein the lock includes a light-emitting diode (LED), and the method further comprises:

activating a single red LED to blink once every ten seconds while the lock bolt is in the retracted position.

64. The method of claim 63, further comprising:

storing a parameter related to the number of unsuccessful authorization attempts by the controller since the last successful authorization; and activating a single red LED to blink a number of times equal to the stored parameter prior to recording user input information from the user input device.

65. The method of claim 64, wherein the lock further comprises a change key, and the method further comprises:

inserting the change key into the lock to activate a configuration mode;

recording a first set of user input information from the user input device;

recording a second set of user input information from the user input device;

averaging the first set and second set of user input information together; and replacing the authorization information stored in the controller with the averaged user input information.

66. A method of operating a lock including manually-driven gear train, a lock bolt operatively coupled to the gear train, a retractable bolt shield, and at least one mounting bolt in a bolt receptacle, the method comprising:

driving the lock bolt from a retracted position to an extended position by manually driving the gear train; and sliding the retractable bolt shield over the mounting bolt in the bolt receptacle as the lock bolt moves from the retracted position to the extended position.

67. The method of claim 66, wherein the lock includes a light-emitting diode (LED), and the method further comprises:

activating a single red LED to blink once every ten seconds while the lock bolt is in the retracted position.

68. The method of claim 67, wherein the lock includes a user input device and a controller, the method further comprising:

recording user input information from the user input device;

verifying that the user input information matches authorization information stored in the controller;

storing a parameter related to the number of unsuccessful authorization attempts by the controller since the last successful authorization; and activating a single red LED to blink a number of times equal to the stored parameter prior to recording user input information from the user input device.

69. The method of claim 68, wherein the lock further comprises a change key, and the method further comprises:

inserting the change key into the lock to activate a configuration mode;

recording a first set of user input information from the user input device;

recording a second set of user input information from the user input device;

averaging the first set and second set of user input information together; and replacing the authorization information stored in the controller with the averaged user input information.

70. A method of operating a lock including a light-emitting diode (LED), a user input device, and a controller, the method further comprising:

recording first user input information from the user input device;

verifying that the first user input information matches authorization information stored in the controller;

storing a parameter related to the number of unsuccessful authorization attempts by the controller since the last successful authorization; and activating a single red LED to blink a number of times equal to the stored parameter prior to recording second user input information from the user input device.

71. The method of claim 70 further comprising:

activating a single red LED to blink a number of times equal to the stored parameter prior to recording user input information from the user input device.

72. The method of claim 70, wherein the lock further comprises a change key, and the method further comprises:

inserting the change key into the lock to activate a configuration mode;

recording a first set of user input information from the user input device;

recording a second set of user input information from the user input device;

averaging the first set and second set of user input information together; and replacing the authorization information stored in the controller with the averaged user input information.

73. A method of operating a lock including a user input device, a controller, and a change key, the method further comprises:

inserting the change key into the lock to activate a configuration mode;

recording a first set of user input information from the user input device;

recording a second set of user input information from the user input device;

averaging the first set and second set of user input information together; and replacing authorization information stored in the controller with the averaged user input information.

74. The method of claim 73, wherein the lock further comprises a light-emitting diode (LED), and the method further comprises:

activating a single red LED to blink once every ten seconds while the lock bolt is in the retracted position.

* * * * *